US006209980B1

(12) United States Patent
Kobayashi et al.

(10) Patent No.: US 6,209,980 B1
(45) **Date of Patent: *Apr. 3, 2001**

(54) INK CARTRIDGE FOR PRINTER HAVING ELECTRODES

(75) Inventors: Takao Kobayashi; Hisashi Miyazawa; Seiji Mochizuki, all of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/880,453

(22) Filed: Jun. 24, 1997

(30) Foreign Application Priority Data

| | | |
|---|---|---|
| Jun. 25, 1996 | (JP) | 8-182740 |
| Aug. 6, 1996 | (JP) | 8-221831 |
| Aug. 6, 1996 | (JP) | 8-221832 |
| May 12, 1997 | (JP) | 9-135787 |

(51) Int. Cl.[7] ..... B41J 2/195
(52) U.S. Cl. ..... 347/7
(58) Field of Search ..... 347/7, 19, 85, 347/86, 87

(56) References Cited

U.S. PATENT DOCUMENTS

| | | | | |
|---|---|---|---|---|
| 5,051,759 | | 9/1991 | Karita et al. . | |
| 5,255,019 | * | 10/1993 | Mochizuki et al. | 347/7 |
| 5,657,058 | * | 8/1997 | Mochizuki et al. | 347/7 |

FOREIGN PATENT DOCUMENTS

| | | | | |
|---|---|---|---|---|
| 0 440 110 | | 8/1991 | (EP) . | |
| 0 509 747 A1 | * | 4/1992 | (EP) | 347/7 |
| 0 509 747 | | 10/1992 | (EP) . | |
| 0 615 846 | | 9/1994 | (EP) . | |
| 0 615 846 A1 | * | 11/1994 | (EP) | 347/7 |
| 0 684 135 | | 11/1995 | (EP) . | |
| 2-198866 | | 8/1990 | (JP) . | |
| 3-277558 | | 12/1991 | (JP) . | |
| 5-270001 | | 10/1993 | (JP) . | |
| 6-262772 | | 9/1994 | (JP) . | |
| 96/05061 | | 2/1996 | (WO) . | |
| WO 96/40524 | | 12/1996 | (WO) . | |
| WO 97/49556 | | 12/1997 | (WO) . | |

* cited by examiner

*Primary Examiner*—John Barlow
*Assistant Examiner*—Charles W. Stewart, Jr.
(74) *Attorney, Agent, or Firm*—Stroock & Stroock & Lavan LLP

(57) ABSTRACT

The invention comprises an ink cartridge wherein a pair of electrodes for detecting the depletion of ink from the ink cartridge for an ink jet printer are positioned within a highly compressed portion of a porous member contained within the ink cartridge. The porous member is highly compressed by an ink supply section in an ink chamber. The electrodes are maintained in contact with electrode plates. One electrode may be disposed so as to be exposed to the inside of an ink supply port defined by the ink supply section. One of the electrodes may be formed of a fine mesh, a portion of the filter being embedded within the cartridge and a portion of the filter being positioned outside the cartridge. The detection plate may be formed with microscopic asperities thereon, formed as microscopic holes or grooves, in areas brought into contact with the electrodes. One electrode may be provided which extends through at least two ink chambers, the electrode aiding in determining whether ink has been depleted from any of the at least two ink chambers. The invention also comprises a mounting device for an ink cartridge, comprising an ink cartridge replacement mode setter, an ink suctioner, a determination circuit for detecting existence of ink in the ink supply section and for determining possibility of printing, and a display for displaying the determination result.

46 Claims, 16 Drawing Sheets

INK CARTRIDGE FOR PRINTER HAVING ELECTRODES

BACKGROUND OF THE INVENTION

This invention relates to an ink cartridge which is loaded into an ink jet printer for printing, a mounting device for retaining the ink cartridge, and detection plates capable of detecting the amount of ink remaining in the ink cartridge, and when this ink has been depleted.

By way of example, an ink detector is shown in Japanese Patent Laid-Open No. Hei 3-277558 (known example 1), and depicts conventional means for detecting when the amount of ink in an ink cartridge is reduced below a predetermined level by printing. The ink end detector depicted in known example 1 is formed with a pair of electrodes placed in through holes formed on an inner wall face of an ink tank, which is used for supplying ink to a printer head. The depletion of the ink from the ink tank is determined as a change in the conduction state between the electrodes caused by the lack of ink therebetween, and therefore an increased resistance. Seal members for preventing ink leakage from around the electrodes are inserted in the outer periphery of the electrodes positioned within an ink cartridge.

By way of an additional example, an ink cartridge is disclosed in Japanese Patent Laid-Open No. Hei 5-270001 (known example 2). A first of two electrodes for detecting when the amount of ink remaining in the ink cartridge falls below a predetermined level is disposed in a chamber of the ink cartridge. The second of the two electrodes is disposed in an ink outlet port of the ink cartridge. A porous material is placed in the ink outlet port below the second ink outlet electrode for preventing air from being sucked into the ink cartridge when the ink cartridge is removed from a printer by providing a sufficient capillary force, thereby blocking any flow of bubbles into the ink cartridge.

By way of a further example, an ink end detector is disclosed in Japanese Patent Laid-Open No. Hei 6-262772 (known example 3). In this ink end detector one electrode is placed in an opening of the ink cartridge and the other electrode is placed in the cartridge. As the resistance value between the electrodes changes, the sucking and removing of bubbles in the proximity of an ink supply port is performed.

By way of yet another example, an additional known ink end detector is disclosed in Japanese Patent Laid-Open No. Hei 2-198866 (known example 4). In this ink end detector, a mesh electrode is placed so as to cover a portion ink supply port extending into the ink tank from where ink exits the ink cartridge. The mesh electrode covers the inner portion of the ink supply port maintained within the ink tank.

The use of the detectors depicted in known examples 1–3, does not greatly affect the supplying of ink from the ink cartridge to printer means. However, in known examples 1 and 2, since one electrode is placed in the ink supply port, there is some degradation of the detection accuracy of the depletion of ink from the ink tank. Since the distance between the two electrodes is great, the resistance between the electrodes is also great, and as a result, the detection accuracy decreases, and may be affected by environmental changes. The placement of the two electrodes in the ink cartridge, rather than in the ink supply port, reduces this problem. Additionally, as is shown in known example 2, in the ink cartridge with the porous material placed in the ink supply port below the electrode contained therein, foreign material may accumulate on the porous material during use, thereby affecting the detection accuracy. Additionally, the apparatus known example 3 is very complicated and costly.

Additionally, as is depicted in known examples 1 and 2, since one electrode is disposed in an ink reservoir or ink support port, apart from the other electrode in the ink reservoir, porous material positioned between the two electrodes increases the detection resistance value. Thus, the accuracy of detection of the required predetermined change in the resistance value in accordance with ink consumption is reduced. Additionally, it is feared that the detection accuracy may largely vary based on environmental factors, such as temperature. Further, since one of the electrodes is positioned within the ink supply port, the port must be large. However, a cartridge provided with a large number of ink chambers for holding different colors for color printing has limited space. Thus, it becomes difficult to provide adequately large ink supply ports to place the electrode therein.

In known example 4 in which the mesh electrode is disposed so as to cover the inner portion of the ink supply port, the device may inaccurately detect the depletion of ink from the ink tank.

Additionally, in known examples 1 and 2, ink leakage prevention means, comprising a rubber stopper or other seal material, is required to seal the electrode which is disposed in the ink reservoir or ink supply port where the electrode passes through the wall of the ink tank.

In each known example in which one electrode is disposed projecting into the ink reservoir or ink supply port, when ink flows past this electrode, the ink flow is disrupted and bubbles are prone to occur in ink, resulting in unstable and inaccurate detection of the depletion of ink from the ink tank. Therefore, it would be beneficial to provide an ink end detector which overcomes these shortcomings of these known detectors.

SUMMARY OF THE INVENTION

Generally speaking, in accordance with the invention, an improved ink end detector is provided. In order to overcome the problems of the known ink end detectors, the invention includes an ink cartridge for an ink jet printer comprising an ink chamber containing a porous material impregnated with ink and wherein paired electrode pins for detecting the depletion of ink from the ink tank are disposed in the proximity of an ink supply section in the ink chamber. The electrodes are positioned so as to penetrate a highly compressed portion of the porous material in the proximity of the ink supply section. The electrode pins are formed as thin needles and are pressingly engaged at their base points with electrode plates which are in turn electrically coupled with determiners which utilize information from the electrode pins to determine if the ink has been depleted. The electrode pins are placed so as to penetrate the porous material so as to traverse the ink chamber of the ink cartridge.

The invention also comprises an ink cartridge for an ink jet printer comprising an ink chamber containing a porous material impregnated with ink, wherein one of a pair of electrode pins is disposed so as to penetrate a highly compressed portion of the porous material in the ink chamber and the other is disposed so as to be exposed to an internal portion of an ink supply port of an ink supply section.

The invention further comprises an apparatus for mounting an ink cartridge for an ink jet printer, comprising electrode pins positioned within the ink cartridge capable of detecting the depletion of ink from the ink cartridge, the device comprising at least an ink cartridge replacement mode setter, an ink suctioner, and a determination circuit for detecting the existence of ink in an ink supply section and determining whether a printing process may be performed. The result of the determination circuit as to whether a printing process may be performed may be displayed.

The invention further comprises an ink cartridge for a recording apparatus containing porous material for holding ink and comprising a pair of electrodes for detecting the amount of ink remaining. A filter is disposed facing the porous material in the proximity of an ink supply section where a capillary force generated by the porous material is comparatively large. At least one of the pair of electrodes is electrically connected to the filter. The filter is formed so as to generate a capillary force stronger than that generated by the porous member. The at least one electrode and the filter are electrically connected by an electric conductor. The second of the pair of electrodes is disposed on a raised portion of the wall of the ink tank at a position lower than the position of the filter in the ink chamber. An outer end portion of one of the electrodes is bent outside the ink tank and an open end thereof abuts against a side wall of the cartridge. An intermediate projection of the bent electrode can be brought into elastic contact with a detection plate of a detection circuit. One of the electrodes may be made of a filter formed of a fine mesh, a first portion of the filter may be embedded in the wall of the cartridge and a second portion of the filter may be disposed on an outside portion of the cartridge. An ink supply section in the ink chamber may be formed with an enlarged projection and an inner end portion of the filter may be embedded therein by insert molding, etc.

A detection plate of an ink end detection apparatus may be connected to a detection circuit and positioned so as to be in electrical communication with electrodes of a cartridge. The detection plate may be formed with microscopic asperities in areas brought into contact with the electrodes. The microscopic asperities may be formed of microscopic holes or microscopic grooves.

The invention also comprises an ink recorder cartridge for a recording apparatus containing a porous member adapted to hold ink and comprising paired electrodes for detecting the amount of ink remaining wherein one of the paired electrodes is embedded in a wall of an ink vessel formed of a thermoplastic material such as a synthetic resin material by insert molding so that it is exposed partially to an ink supply port formed in an ink supply section of the ink vessel.

An ink conducting hole smaller than the ink supply port may be formed in the electrode facing the ink supply port. A cylindrical boss may be formed extending along the periphery of the ink conducting hole of the electrode.

The invention also comprises an ink cartridge comprising a plurality of ink chambers containing porous materials therein capable of separately storing different color inks, wherein one of an associated pair of electrodes for detecting the depletion of ink is inserted into each of the plurality of ink chambers.

It is therefore a first object of the invention to provide an improved ink cartridge capable of precisely detecting the depletion of ink from an ink cartridge.

It is a second object of the invention to provide an ink cartridge which improves contact between the electrode pins and electrode plates.

It is a third object of the invention to provide an ink cartridge which decreases the number of parts and simplifies assembly.

It is a fourth object of the invention to provide an ink cartridge mounting device having a simple structure which insures safe, good printing It is a fifth object of the invention to provide a cartridge comprising electrodes which detect the depletion of ink with a high reliability.

It is a sixth object of the invention to provide a cartridge comprising a filter positioned in an ink supply section, the filter acting as an electrode for detecting the depletion of ink.

It is a seventh object of the invention to provide a cartridge capable of maintaining a good electrical connection between a filter and electrode.

It is an eighth object of the invention to provide a cartridge and detection plates which are maintained in electric conduction.

It is a ninth object of the invention to provide a cartridge comprising a filter acting as an electrode which decreases the spacing between a pair of electrodes, and thus enhances detection accuracy.

It is a tenth object of the invention to provide a cartridge not requiring any seal material for preventing ink leakage at the point the electrodes pass through the wall of the ink tank.

It is an eleventh object of the invention to provide a cartridge enabling ink to smoothly flow through an ink supply section which removes any restriction which might generate bubbles.

It is a twelfth object of the invention to provide a cartridge enabling ink to come into contact with electrodes over a wide contact area for accurate detection of the depletion of ink.

It is a thirteenth object of the invention to provide a cartridge having a simplified structure.

It is a fourteenth object of the invention to provide a cartridge having multiple ink vessels comprising at least one common electrode for at least two of the vessels for simplifying the structure and reducing the costs associated with construction.

The invention accordingly comprises the features of construction, combination of elements, and arrangement of parts which will be exemplified in the construction hereinafter set forth, and the scope of the invention will be indicated in the claims.

Still other objects and advantages of the invention will in part be obvious and will in part be apparent from the specification.

BRIEF DESCRIPTION OF THE DRAWING

For a fuller understanding of the invention, reference is had to the following description taken in connection with the accompanying drawings, in which.

DETAILED DESCRIPTION OF THE PREFERRED EMBODIMENTS

Figure 1:
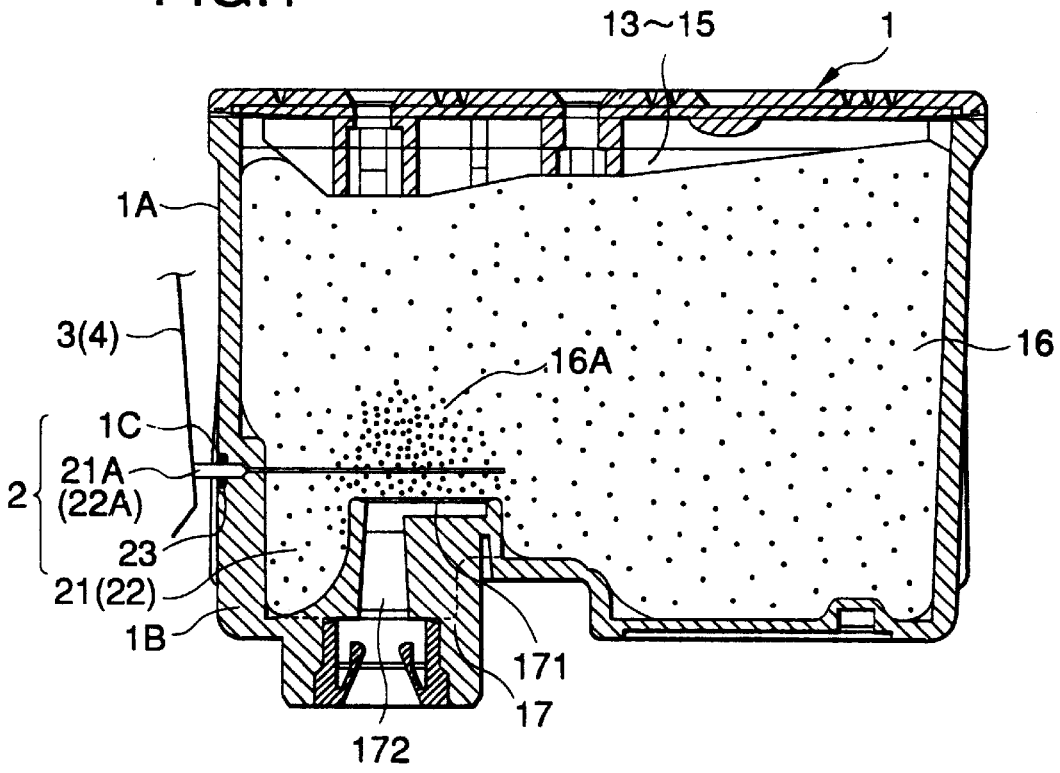
FIG. 1 is a cross-sectional view of an ink cartridge constructed in accordance with a first embodiment of the invention.

The invention will be discussed based on embodiments shown in the accompanying drawings. Reference numerals are classified into a first group for the first to fifth embodiments, a second group for the sixth to eleventh embodiments, and a third group for the twelfth to sixteenth embodiments, like elements being denoted by like reference numerals.

Figure 2:
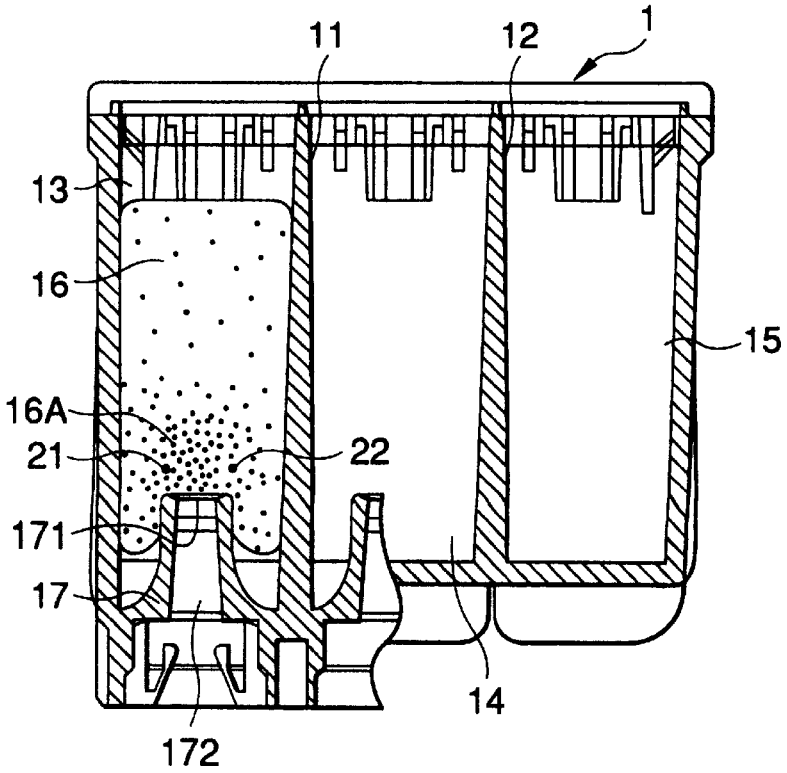
FIG. 2 is a cross-sectional view of the ink cartridge of FIG. 1 taken in a direction orthogonal to the cross-section of FIG. 1 in part through the ink supply ports, in part through another portion of the cartridge.
Figure 3:
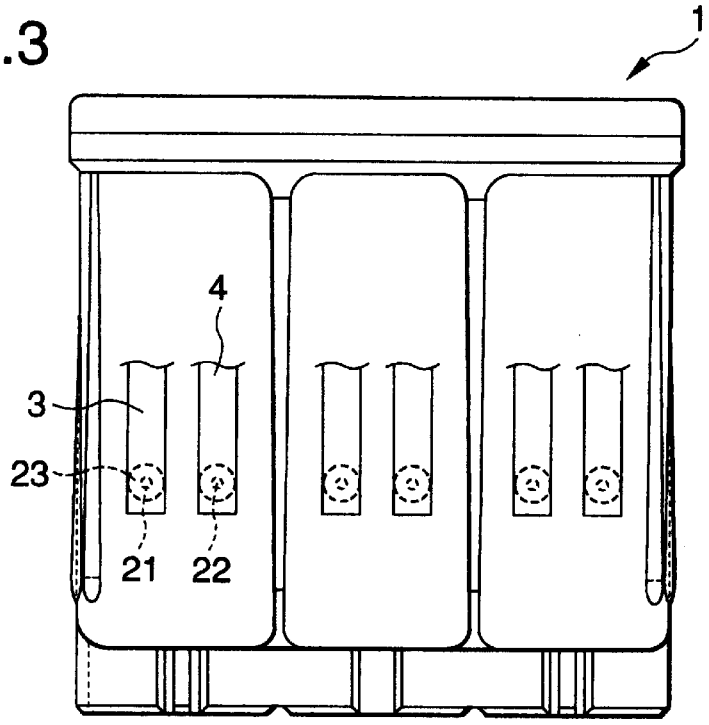
FIG. 3 is a side elevational view of the ink cartridge in FIG. 1.

Embodiment 1:

An ink cartridge, depicted generally as 1 and constructed in accordance with a first embodiment of the invention, is shown in FIGS. 1 to 3. Ink cartridge 1 is formed so as to be able to store a different color ink separately in each of ink chambers 13-15, which are separated by partitions 11 and 12. A porous material 16 capable of holding the ink contained in each ink chamber 13–15 is positioned within each ink chamber 13–15. An associated ink supply section 17 projects from the bottom of each of ink chambers 13–15. The lower portion of each portion of porous material 16 is partially compressed by the associated ink supply section 17, and forms a highly compressed area 16A having an enhanced capillary force to aid in the supply of ink to the associated ink supply portion 17. A filter 171 is positioned on the top of each ink supply section 17 through which ink can be supplied to an associated ink supply port 172 and further to an associated print head (not shown). Ink cartridge 1 is provided with a detection circuit 2 associated with each ink chamber 13–15 for detecting an amount of ink remaining in each ink chamber 13–15. The ink level in each ink chamber 13–15 is decreased gradually in response to printing by the printer, When the ink remaining reaches a predetermined amount, the detector detects that the ink has been depleted from the ink tank.

Detection circuit 2 is formed as follows. A thick electrode support section 1B is formed integral with a side wall 1A of ink cartridge 1. A pair of needle-like electrode pins 21 and 22 (22 not being shown in FIG. 1, but positioned behind pin 21 in FIG. 1) penetrate electrode support section 1B into highly compressed portion 16A of porous material 16 adjacent the top of filter 171. Large-diameter bases 21A and 22A of the electrode pins 21 and 22 respectively are each supported by electrode support section 1A in fluid-tight relation by a corresponding seal ring 23 fitted into a recess 1C of electrode support section 1B. The outer base ends of electrode pins 21 and 22 are pressed and maintained in contact with a pair of electrode plates 3 and 4 (only 3 being visible in FIGS. 1, 4 being positioned behind 3).

When ink cartridge 1 is mounted on a printer, electrode plates 3 and 4, which comprise open ends of a detection circuit, are coupled to electrode pins 21 and 22. When there is sufficient ink in cartridge 1 to conduct a printing operation, water-soluble ink is positioned between electrodes 21 and 22 and is used as an electric conductor. Thus, the detector senses the ink between the electrodes. If sufficient ink exists between electrode pins 21 and 22 and thus between electrode plates 3 and 4, the ink detection circuit detects in a low resistance state between the electrode plates 3 and 4, and it is determined that sufficient ink exists in the cartridge to perform a printing operation. As printing is conducted, the amount of ink in the ink chamber decreases and the electric resistance value between the electrode pins 21 and 22, and thus the electrode plates 3 and 4, increases.

Electrode pins 21 and 22 of ink cartridge 1, which penetrate electrode support section 1B into highly compressed section 16A of the porous material 16, are always maintained in extremely good contact with ink, since ink is concentrated at compression section 16A. Thus, the detector can be expected to provide exceptional, highly reliable ink depletion detection capability. Since electrode pins 21 and 22 are formed as needles, electrode pins 21 and 22 can also easily penetrate electrode support section 1B into porous material 16 for improving assembly efficiency. Additionally, if gold or silver or other noble metal material is used to form electrode pins 21 and 22, conductivity can be improved. Finally, if electrode pins 21 and 22 are plated with gold or silver, costs can be decreased and conductivity improved.

In addition, when it becomes necessary to remove ink cartridge 1 from the printer head for maintenance, inspection, or the like, ink is maintained between electrode pins 21 and 22. Thus, even if ink cartridge 1 is again mounted to the printer without special preparation, ink is maintained between electrode pins 21 and 22, and thus a safe and continuous flow of ink can be provided without a false ink end indication.

Figure 4:
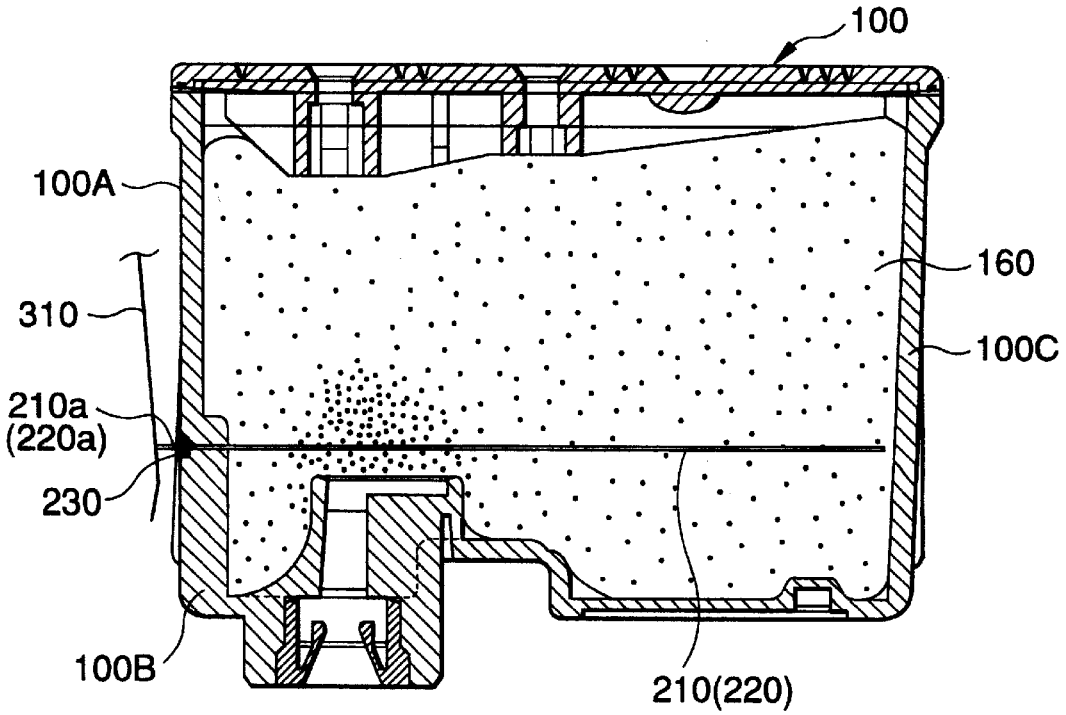
FIG. 4 is a cross-sectional view of an ink cartridge constructed in accordance with a second embodiment of the invention.

Embodiment 2:

An ink cartridge, indicated generally as 100 and constructed in accordance with a second embodiment of the invention, is shown in FIG. 4. Ink cartridge 100 differs from ink cartridge 1 of the first embodiment in that electrode pins 210, 220 are formed as thin needles having an equal cross-sectional area along their entire length. A base 210*a*, 220*a* of each of electrode pins 210, 220 penetrates a thick electrode support section 100B of a side wall 100A of ink cartridge 100, and are supported in fluid-tight relation therewith by associated seal rings 230. A free end of each electrode pin 210, 220 penetrates a porous member 160 and extends across almost the entire length of ink cartridge 100, almost to a position in proximity to an opposed side wall 100C opposite wall 100A of ink cartridge 100. Other components are similar to those of the ink cartridge 1 of the first embodiment.

Therefore, in accordance with this second embodiment of the invention, and as a function of ink cartridge 100, long electrode pins 210 and 220 penetrate porous member 160 along almost the entire length of ink cartridge 100, so that the contact area between electrode pins 210 and 220 and ink contained within ink cartridge 100 is increased, and is therefore more stable. Further, since electrode pins 210 and 220 are formed as thin needles, the contact area between electrode pins 210 and 220 and an electrode plate 310 is drastically reduced to a diameter equal to the cross-sectional area at the end of electrode pins 210 and 220. Thus, even if the pressing pressure of an electrode plate 310 on electrode pins 210 and 220 is reduced, sufficient contract pressure can be provided between electrode pins 210 and 220 and electrode plate 310, thus maintaining sufficient electrical contact therebetween. Thus, ink cartridge 100 provides a highly reliable ink depletion detection device.

Embodiment 3:

An ink cartridge, indicated generally as 400 and a mounting device 500 for mounting of ink cartridge 400, constructed in accordance with a third embodiment of the invention, will be discussed, making reference to FIGS. 5 to 8.

(1) Ink cartridge 400

Figure 5:
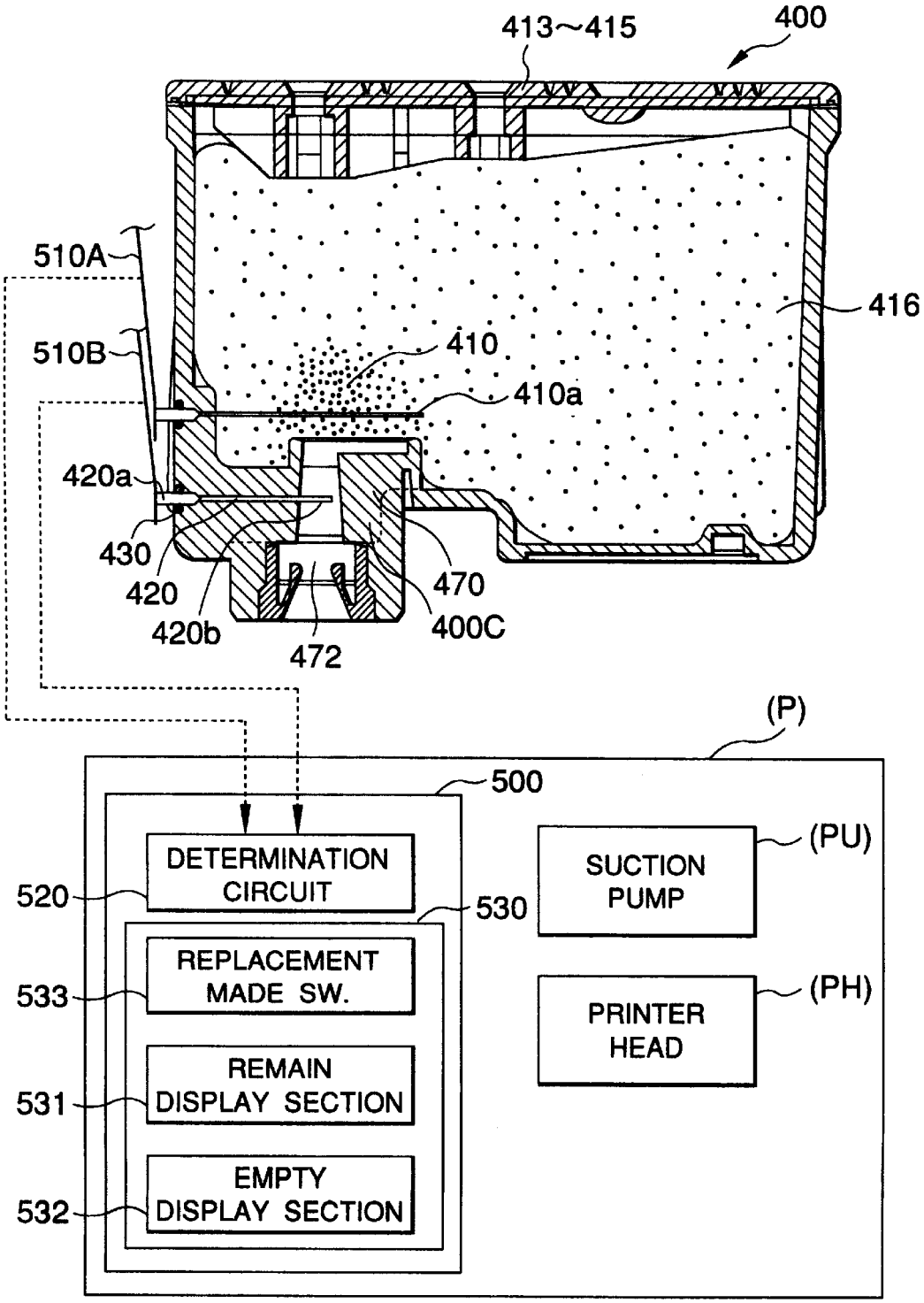
FIG. 5 is a cross-sectional view of an ink cartridge constructed in accordance with a third embodiment of the invention and a functional block diagram of a mounting device of the ink cartridge.
Figure 6:
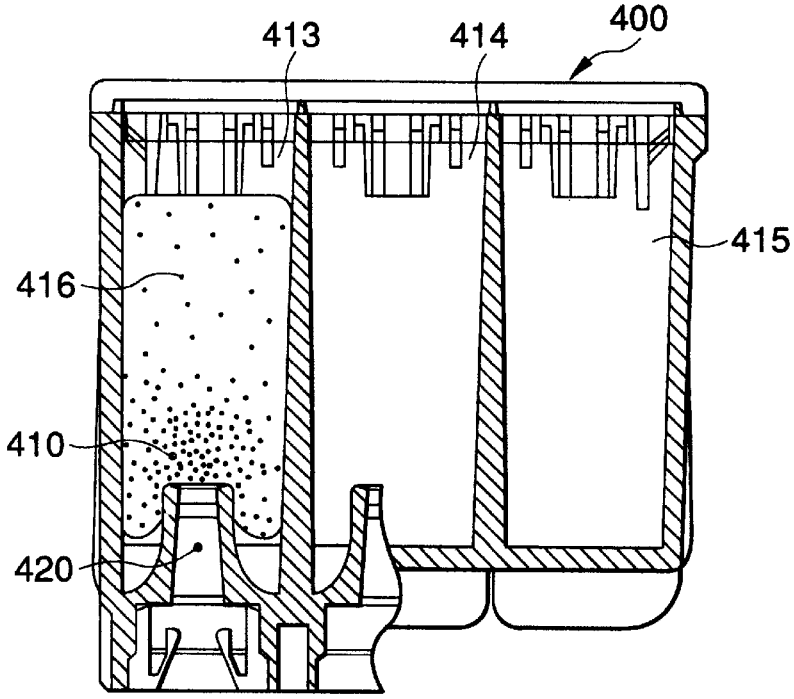
FIG. 6 is a cross-sectional view of the ink cartridge of FIG. 5 taken in a direction orthogonal to the cross-section of FIG. 5 in part through the ink supply ports, in part through another portion of the cartridge.
Figure 7:
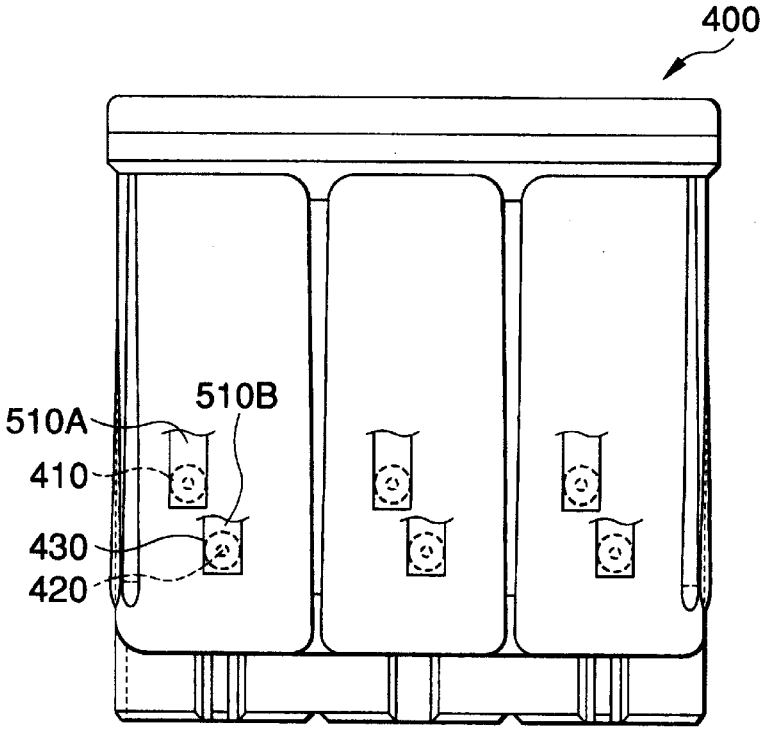
FIG. 7 is a side elevational view of the ink cartridge in FIG. 5.

Ink cartridge 400 is depicted generally in FIG. 5, and differs from ink cartridge 1 of the first embodiment in that a second electrode pin 420, which is formed with a base 420*a* with a greater cross-sectional area than the tip 420*b*, is positioned to penetrate a thick bottom wall 400C of ink cartridge 400. Tip 420*b* of second electrode pin 420 is placed so as to be positioned within an ink supply port 472 of an ink supply section 470. The large-diameter base portion of second electrode pin 420 is sealed in fluid-tight relation by a seal ring 430. Base portion 420*a* projects beyond the outer edge of ink cartridge 400 and is pressed into contact with an electrode plate 510A, 510B of mounting device 500 (described below).

Components similar to ink cartridge 1 of the first embodiment are indicated by similar reference numerals.

(2) Ink cartridge mounting device 500

As is further shown in FIG. 5, mounting device 500 for mounting ink cartridge 400 for use in a printer (P) comprising a printer head (PH), a suction pump (PU), etc., is electrically coupled to ink cartridge 400 through electrode plates 510A, 510B and electrode pins 410, 420. Mounting device 500 is provided with an ink cartridge receiving section (not shown) for receiving ink cartridge 400 in a position at which electrode pins 410, 420 engage electrode plates 510A, 510B, and determination circuit 520 for determining whether or not ink remains in the ink tank, and therefore can be supplied in association with measurements received from electrode plates 510A and 510B.

Mounting device 500 further includes a display panel 530 equipped with a REMAIN display section 531 for indicating that sufficient ink remains in ink cartridge 400 and can be supplied for printing, an EMPTY display section 532 indicating that sufficient ink does not remain within ink cartridge 400, or that some other ink problem, such as air mixed with the ink, requires that ink not be supplied for printing, and a replacement mode switch 533 used to allow replacement of ink cartridge 400. The determination of whether sufficient ink is present in ink cartridge 400, and therefore whether printing can take place, is made by determination circuit 520 based upon values received from electrode plates 510A, 510B, and electrode pins 410 and 420.

(3) Mounting Procedure of Ink Cartridge 400

Figure 8:
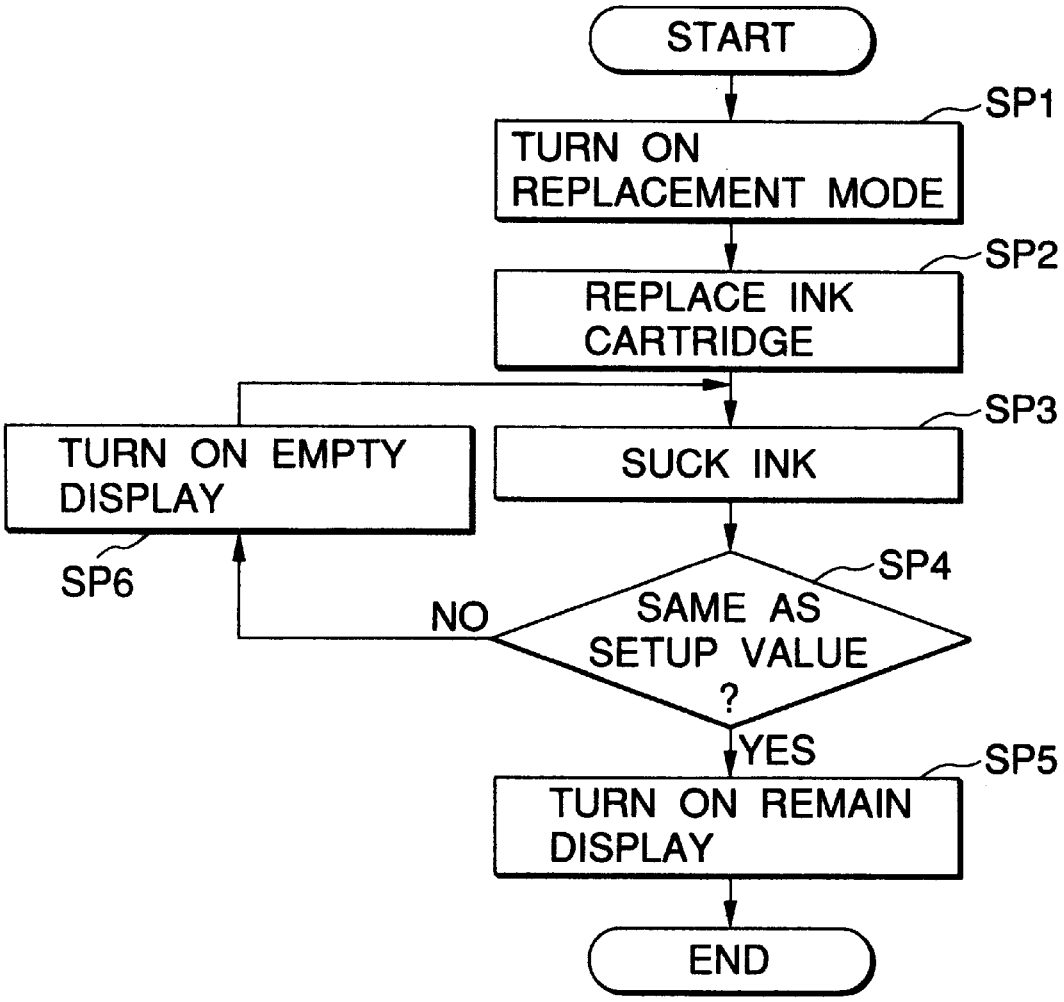
FIG. 8 is a flowchart depicting the functioning of the ink cartridge of this third embodiment.

A procedure for mounting ink cartridge 400 will be discussed with reference to the flowchart shown in FIG. 8.

Ink cartridge 400 is loaded into the printer (P). If electricity may be conducted between first and second electrode pins 410 and 420 because of ink positioned therebetween, it is determined that safe printing may take place, and printing by printer (P) is enabled. If the ink in ink cartridge 400 runs low, a high resistance value is measured between electrode pins 410 and 420 since no conductive liquid will be present between electrode pins 410, 420, thereby, alerting the operator as to the necessity for replacing ink cartridge 400, as in the other embodiments.

When an empty ink cartridge 400 is replaced with new ink cartridge 400, during mounting air bubbles may be sucked into ink supply port 472, and the print quality will degrade. Because of these air bubbles, electricity will not be conducted between first and second electrode pins 410 and 420, and it is thus determined that there is no ink adjacent first and second electrode pins 410 and 420 and the ink detection device will indicate that the ink has been depleted from the ink tank. Thus, even if sufficient ink remains in ink cartridge 400, the ink cartridge 400 cannot be used.

In order to remedy this state in which such air bubbles enter ink supply port 472, a small amount of ink, and hopefully the air bubbles, is sucked from ink cartridge 400 and the air bubbles are removed.

Thus, during use, the operator operates replacement mode switch 533 for setting the switch to a replacement mode of ink cartridge 400 at step SP1. Next, ink cartridge 400 is replaced at step SP2. After ink cartridge 400 is properly mounted, suction pump (PU) is started sequentially for sucking a small amount of ink from ink cartridge 400 and extracting any air bubbles from ink supply port 472 at step SP3.

Next, determination circuit 520 compares the resistance measured between electrode pins 410, 420 with a predetermined resistance value at step SP4. If it is determined that the measured electrical resistance is less than the predetermined resistance value, determination circuit 520 confirms that the air bubbles have been removed from ink supply port 472 and that the portion of ink cartridge 400 adjacent first and second electrode pins 410 and 420 is filled with ink, REMAIN display section 531 is displayed, and print head (PH) stands by printing at step SP5.

However, if bubbles still remain within ink supply section 470, EMPTY display section 532 is displayed at step SP6 and control returns to step SP3 at which ink is again sucked to remove any bubbles which have not yet been removed. Therefore, through the use of mounting device 500, highly reliable printing can also be executed safely after ink cartridge 400 is loaded.

Figure 9:
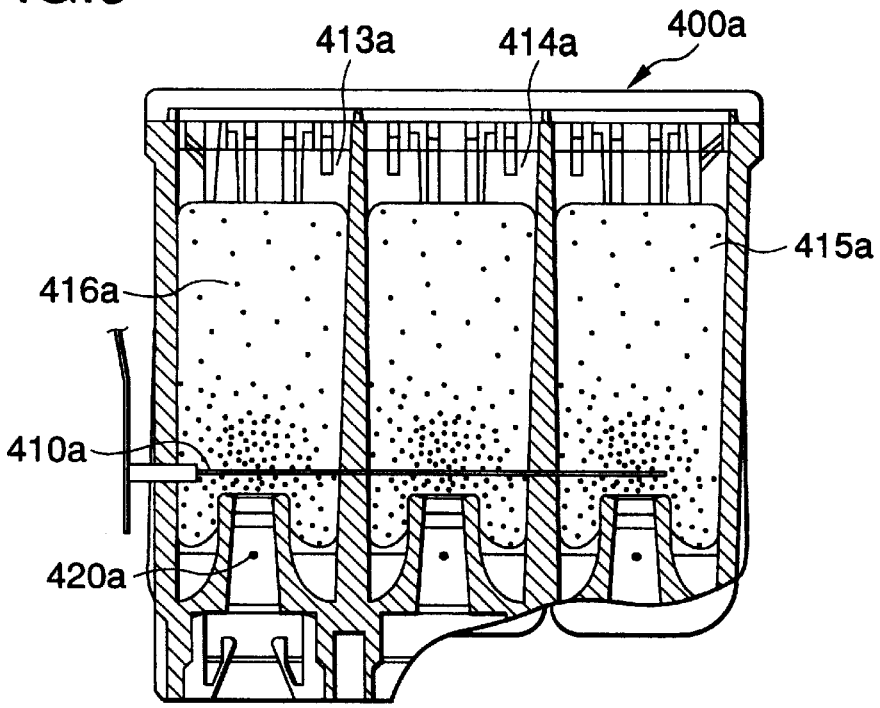
FIG. 9 is a cross-sectional view of an ink cartridge constructed in accordance with a fourth embodiment of the invention.

Embodiment 4:

An ink cartridge, indicated generally as 400*a* and constructed in accordance with a fourth embodiment of the invention, is shown in FIG. 9. Ink cartridge 400*a* differs from ink cartridge 400 of the third embodiment shown in FIGS. 5 to 8 in that a first electrode pin 410*a* is disposed so as to penetrate across different color ink chambers 413*a*, 414*a*, and 415*a* contiguous with each other for detecting the depletion of ink from any of the ink chambers.

As is shown in FIG. 9, the lack of sufficient ink in any of ink chambers 413*a*, 414*a*, and 415*a* can be more accurately detected, and moreover the configuration of the detection circuit can be greatly simplified. Other components of this fourth embodiment are almost similar to those of the third embodiment and therefore are indicated by reference numerals with suffix a.

Figure 10:
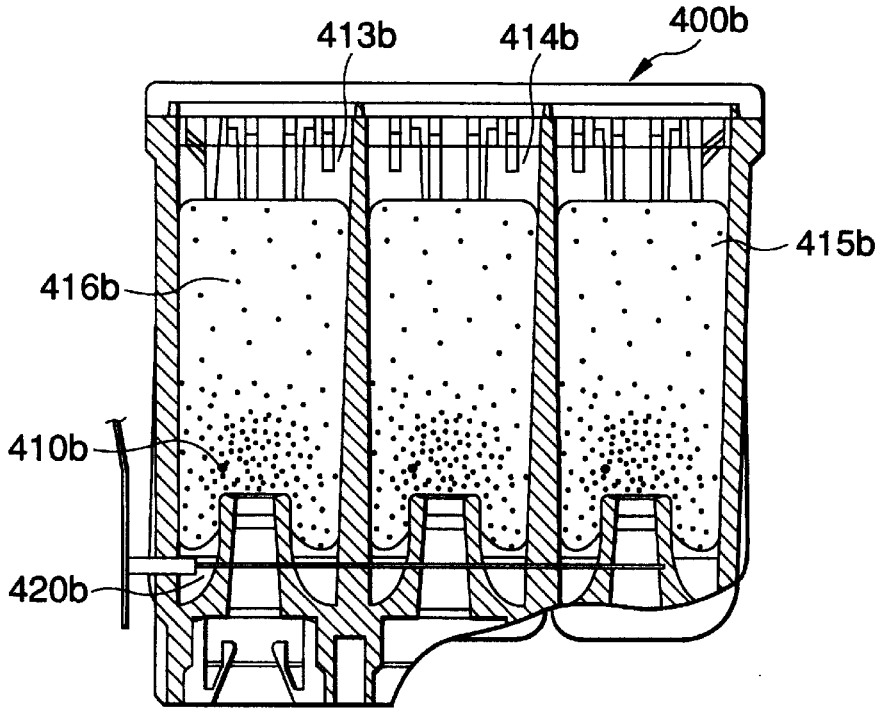
FIG. 10 is a cross-sectional view of an ink cartridge constructed in accordance with a fifth embodiment of the invention.

Embodiment 5:

An ink cartridge, indicated generally as 400*b* and constructed in accordance with a fifth embodiment of the invention, is shown in FIG. 10. Ink cartridge 400*b* differs from the ink cartridge 400*a* of the fourth embodiment shown in FIG. 9 in that a second electrode pin 420*b* is disposed so as to penetrate across different color ink chambers 413*b*, 414*b*, and 415*b* contiguous with each other for detecting the depletion of ink from any of the ink chambers. It has similar advantages to those of the ink cartridge 400*a* of the fourth embodiment.

Other components of the fifth embodiment which are similar to the components of prior embodiments are indicated by reference numerals in FIG. 9 to which suffix b is added.

Figure 11:
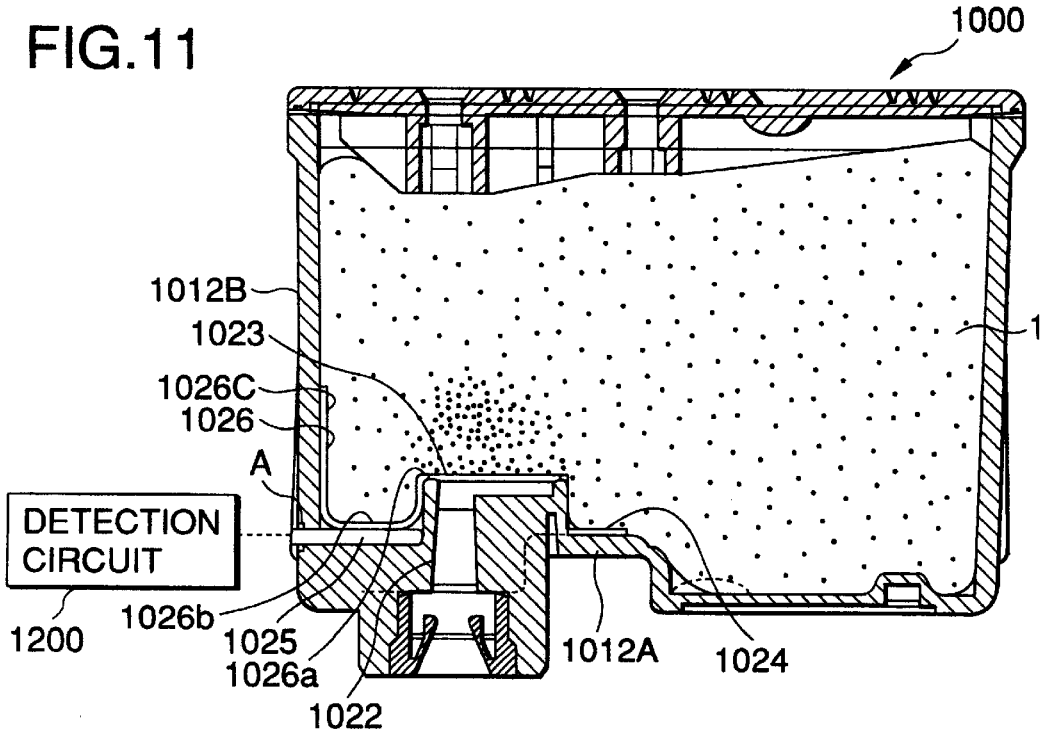
FIG. 11 is a cross-sectional view of an ink cartridge constructed in accordance with a sixth embodiment of the invention.
Figure 12:
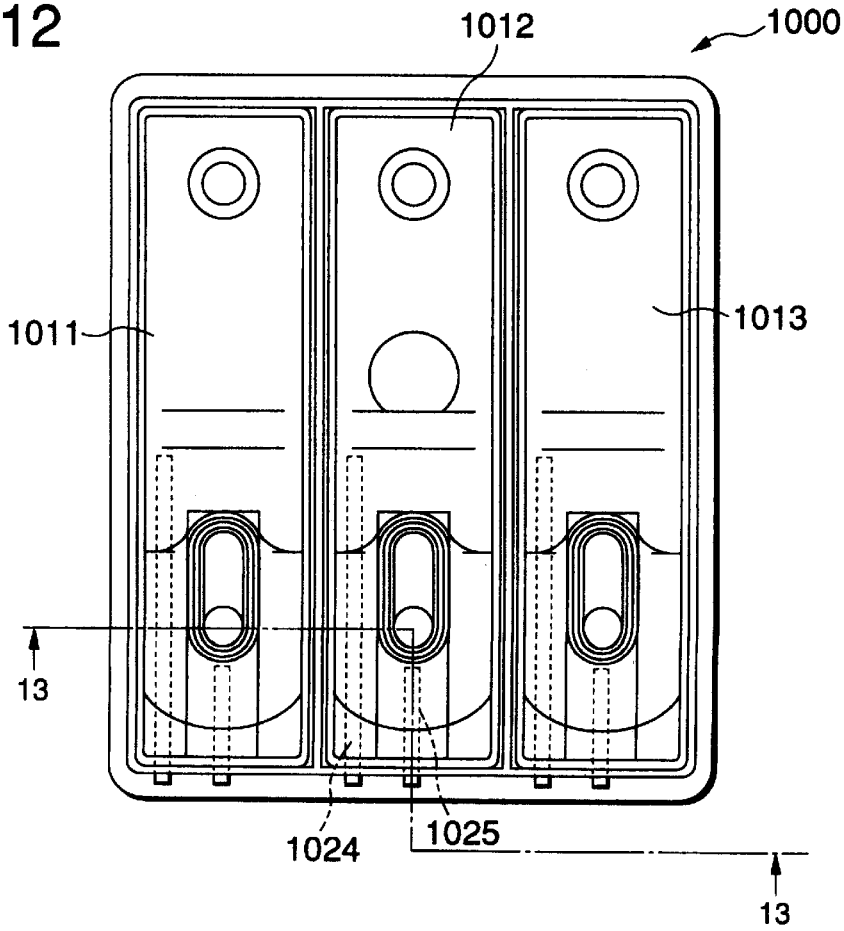
FIG. 12 is a bottom plan view of the ink cartridge of FIG. 11.
Figure 13:
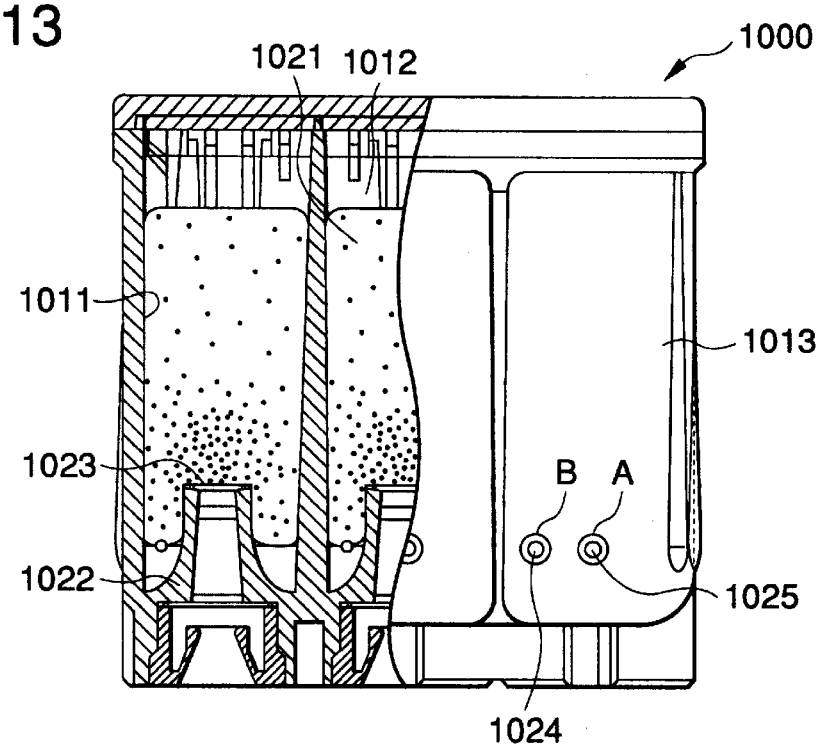
FIG. 13 is a cross-sectional view taken along line 13—13 in FIG. 12.

Embodiment 6:

An ink cartridge, depicted generally as 1000 and constructed in accordance with a sixth embodiment of the invention, is shown in FIGS. 11 to 13. Ink cartridge 1000 is a color ink cartridge comprising ink chambers 1011—1013 for storing ink. In a preferred embodiment, this ink may comprise three different color inks, yellow, magenta, cyan, or the like. Since the features of ink chambers 1011—1013 are in common of this description will refer to chamber 1012 only as a representative of ink chambers 1011–11013.

Ink chamber 1012 contains a porous member 1021 therein. A filter 1023 formed of a conducting material is positioned on the top of an ink supply section 1022 projecting inward to the interior of ink chamber 1012, as in conventional cartridges.

A first long electrode 1024 penetrates a side wall 1012B and is positioned on a raised bottom 1012A within chamber 1012 so at to be maintained in sufficient contact with porous member 1021. An outer end of electrode 1024 extends through a seal ring B to the exterior of the cartridge. A U-shaped electric conductor 1026 is connected at a front end 1026*a* thereof to filter 1023, is connected at a rear end 1026*c* thereof into elastic contact with the inner face of side wall 1012B and is in turn brought at a center portion 1026*b* thereof into elastic contact with a second, short electrode 1025. An outer end of electrode 1025 extends through a seal ring A to the exterior of the cartridge. Second electrode 1025 is positioned adjacent to first electrode 1024, being separated therefrom by porous member 1021. When cartridge 1000 is loaded into a printer (not shown) so as to face the ink head, power is supplied to first and second electrodes 1024 and 1025 by detection circuit 1200 of the printer. First and second electrodes 1024 and 1025 are brought into an electrically conductive state by means of ink contained in porous member 1021 adjacent first and second electrodes 1024 and 1025 in ink chamber 1012. Any variance in the electric resistance value between first and second electrodes 1024 and 1025, which varies according to a change in the remaining amount of ink, is detected by detection circuit 1200.

The pores of filter 1023 generate a stronger capillary force than the capillary force generated by the portion of porous member 1021 adjacent filter 1021 As the ink in porous member 1021 is consumed and the amount of ink decreases, the electric resistance value between the first and second electrodes 1024 and 1025 grows. By measuring this electric resistance value, when the electric resistance reaches a predetermined value it can be precisely determined when the ink has been depleted from the ink tank. Porous member 1021 is loaded so that it is compressed to the greatest extent, and therefore has the maximum capillary force, in the proximity of the filter 1023. Thus, the ink is guided stably into the area of porous member 1021 adjacent to filter 1023 until the ink is depleted from the ink cartridge. In this area adjacent filter 1023, the existence of ink is detected by the first and second electrodes 1024 and 1025. Because of this increased capillary force adjacent filter 1023, the spacing between first and second electrodes 1024 and 1025 can be decreased while the depletion of ink from cartridge 1000 can be accurately detected. Thus, all of the ink in cartridge 1000 will be depleted before a new cartridge must be placed onto the printer. Thus, waste of ink is eliminated and high-quality printing can be provided for a longer time.

First electrode 1025 is electrically connected to filter 1023 via electric conductor 1026. Filter 1023 serves a function as an electrode, and also generates a capillary force larger than porous member 1021 adjacent filter 1023. Thus, even if cartridge 1000 is removed from the printer carelessly during the use, air will not flow into porous member 1021 through filter 1023. Thus, ink cartridge 100 can be replaced in the printer without resulting in a false ink end reading because of air bubbles in the ink, and a print failure caused by an ink-out condition does not occur.

Porous member 1021 is therefore brought into contact with filter 1023 at a position at which ink and air do not mix, no air being able to enter ink cartridge 1012. Thus, at least second electrode 1025 comes into reliable contact only with ink and not with air, and therefore the measured conduction resistance value is more stable. Thus, highly-reliable ink depletion detection can be insured. Further, as viewed from second electrode 1025, electric conductor 1026 is brought into contact with filter 1023 by utilizing the compression force generated by porous member 1021, so that the detection of the depletion of ink becomes more reliable.

First electrode 1024 is placed on raised bottom 1012A. Porous member 1021 is compressed to a greater extent at the position of second electrode 1025. Thus, the capillary force is at a maximum at the position of filter 1023, where porous member 1021 is most compressed. Thus, a mistake in the detection of ink can be prevented during ink supply by precluding air bubbles from entering into ink cartridge 1000 when cartridge 1000 is loaded onto the printer.

The same description applies to the other different color ink chambers 1011 or 1012 of cartridge 1000 and therefore a detailed description of ink chambers 1011 and 1013 will not be provided.

Figure 14:
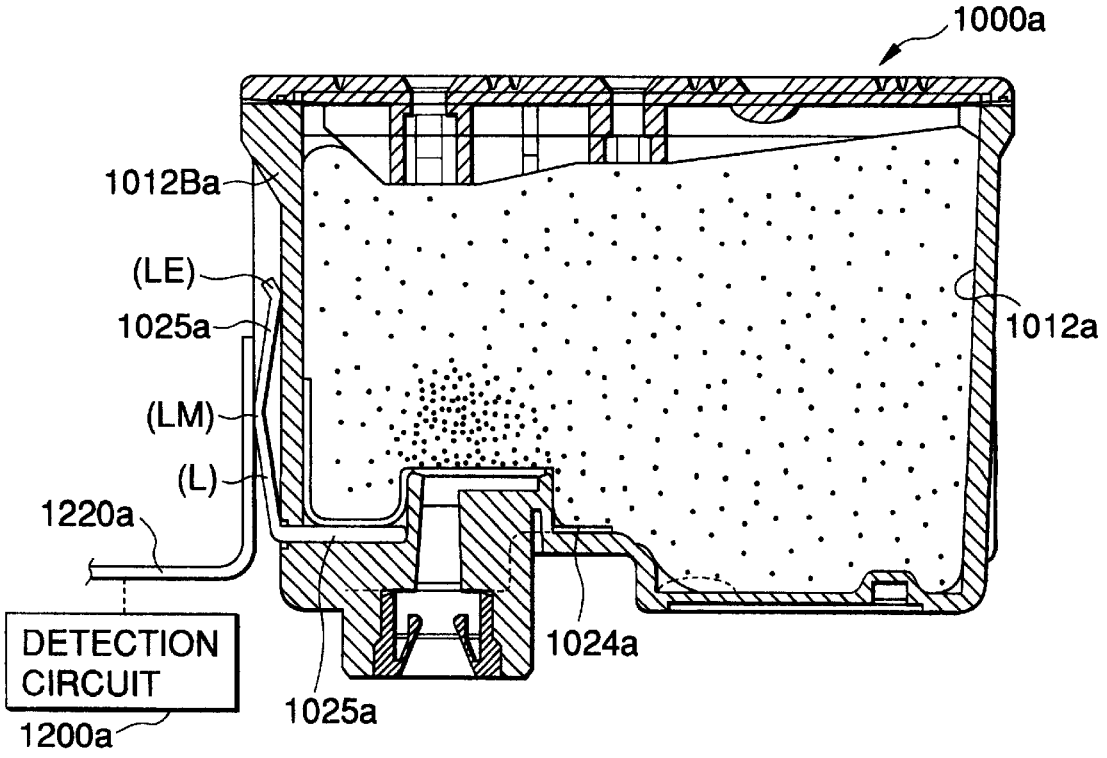
FIG. 14 is a cross-sectional view of an ink cartridge constructed in accordance with a seventh embodiment of the invention.
Figure 15:
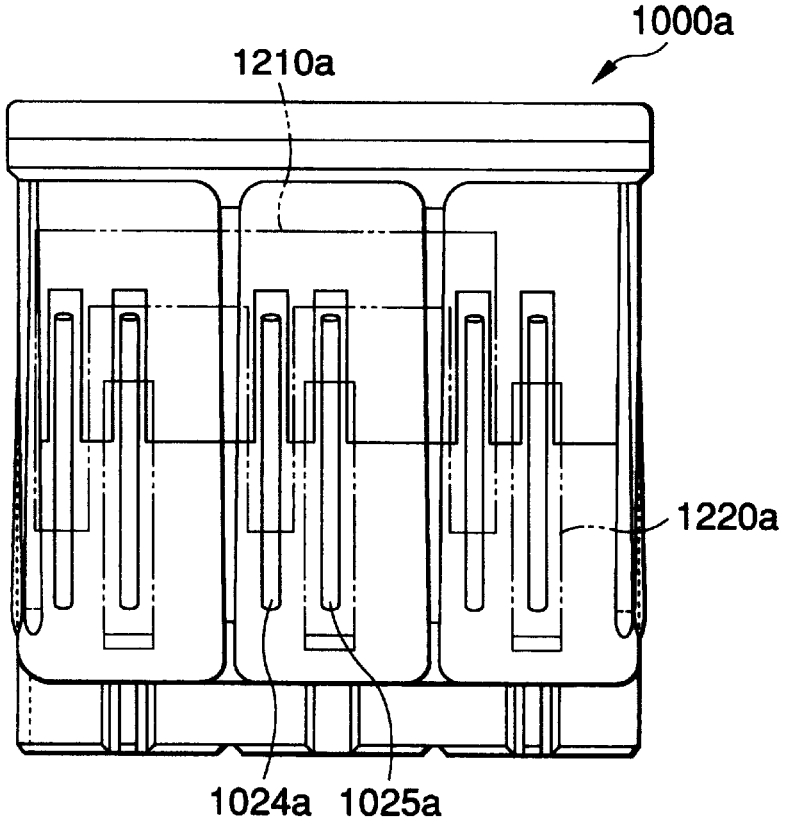
FIG. 15 is a side elevational view of the cartridge of FIG. 14.
Figure 16:
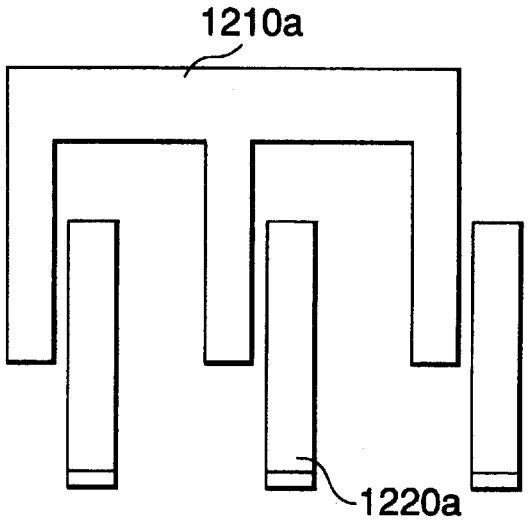
FIG. 16 is a plan view of first and second detection plates as shown in FIG. 15.

Embodiment 7:

An ink cartridge, depicted generally as 1000*a* and constructed in accordance with a seventh embodiment of the invention, is shown in FIGS. 14 and 15. Ink cartridge 1000*a* differs from cartridge 1000 of the sixth embodiment in that first and second electrodes 1024*a* and 1025*a* each have outer an end portion L projecting from a side wall 1012Ba of an ink chamber 1012*a*. Each outer end portion L is formed with a bent structure, the inner face of an open end LE positioned abutting side wall 1012Ba, whereby a biasing force is provided by portion L. The outer face of intermediate projection LM of each of the three first electrodes 1025*a* is brought into elastic contact with an arm of a first detection plate 1210*a* shaped like the letter "E", the outer face of intermediate projection LM of each of the three second electrodes 1024*a* is brought into elastic contact with one of the arms of second detection plates 1220*a*, each shaped like the letter "I" and positioned adjacent to an arm of first detection plate 1210*a* as shown in FIG. 16 in a detection circuit 1200*a*. Other components are similar to those of the cartridge 1000.

If an electrode 1024*a* or 1025*a* is deformed because cartridge 1000*a* is handled incorrectly and, for example, it is feared that the positioning of the electrode may be impaired, thus possibly disrupting the required electrical connection between the electrode and the detection plates, the biasing force of portion L can ensure contact between the electrode and detection plates. As a result, an erroneous determination that the ink has been depleted, caused by a contact failure between one of first and second electrodes 1024*a* and 1025*a* and the corresponding first or second detection plates 1210*a* or 1220*a* can be prevented.

If outer end part L becomes permanently deformed because it is handled incorrectly, cartridge 1000*a* can be replaced with a new cartridge, immediately solving the problem of contact failure.

Figure 17:
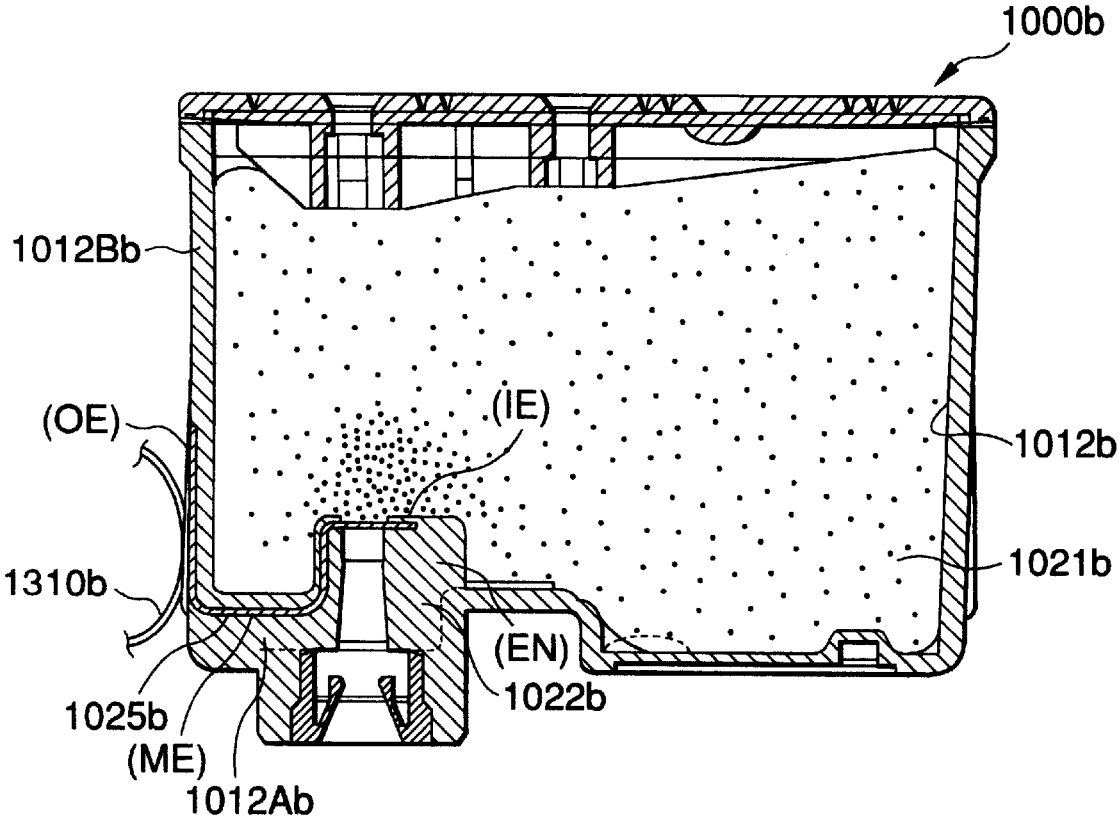
FIG. 17 is a cross-sectional view of an ink cartridge constructed in accordance with an eighth embodiment of the invention.

Embodiment 8:

An ink cartridge, depicted generally as 1000*b* and constructed in accordance with an eighth embodiment of the invention, is shown in FIG. 17. Ink cartridge 1000*b* differs from cartridge 1000 or 1000*a* in that a second electrode 1025*b* is formed completely of a fine mesh comprising a filter formed of a conductive material. Inner end portion IE of second electrode 1025*b* is embedded in a portion of an ink supply section 1022*b* opposing the top of ink supply section 1022*b*. Intermediate portion ME of second electrode 125*b* is embedded in a bottom wall 1012Ab of ink cartridge 1000*b*. Outer end portion OE is bent upward in FIG. 17 and abuts the outer surface of a side wall 1012Bb of ink cartridge 1000*b*. When cartridge 1000*b* is manufactured, ink chamber 1012*b* and second electrode 1025*b*, formed of mesh to form a filter, are molded in one piece by insert molding or the like. Ink supply section 1022*b* is formed with an enlarged projection EN for enlarging the contact area between ink supply section 1022*b* and with porous member 1021*b*.

Therefore, when constructing cartridge 1000*b*, the ink chamber 1012*b* and second electrode 1025*b* are molded in one piece by insert molding or the like. Electrode 1025*b* can therefore be attached to ink chamber 1012*b* so that ink leakage from the insertion point of the electrode can be prevented completely. Further, portion OE of second electrode 1025*b*, which is formed of a mesh filter, is brought into contact with a detection plate 1310*b* of a printer. Thus, when cartridge 1000*b* is mounted, electrode 1025*b* is rubbed against detection plate 1310*b* during relative movement and fine dust, etc., deposited on the surface of the mesh filter material is removed, insuring good electric conductivity therebetween. Moreover, the dust, etc., is drawn into the mesh structure, serving a self-cleaning function.

Since ink supply section 1022*b* comprises enlarged projection EN, the portion of porous member 1021*b* which experiences the greatest compression can be expanded. Thus, the flow of ink through porous member 1021*b* can be maintained until the ink is completely depleted from the ink tank. Thus, much more of the ink from the ink tank ink can be supplied to a printer head for printing.

Figure 18:
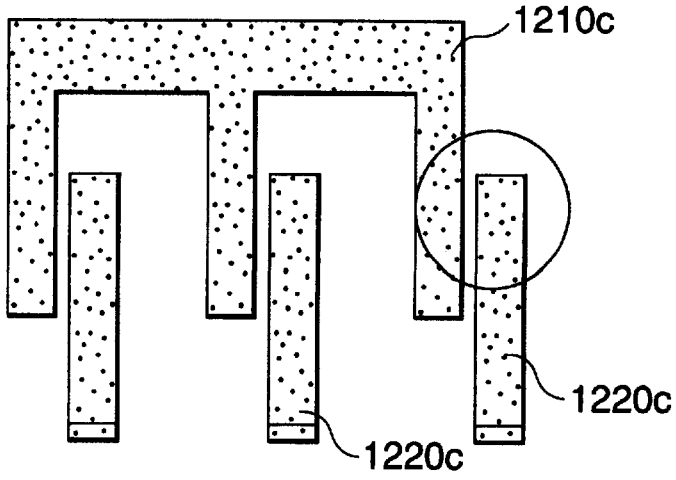
FIG. 18 is a plan view of first and second detection plates constructed in accordance with a ninth embodiment of the invention.
Figure 19:
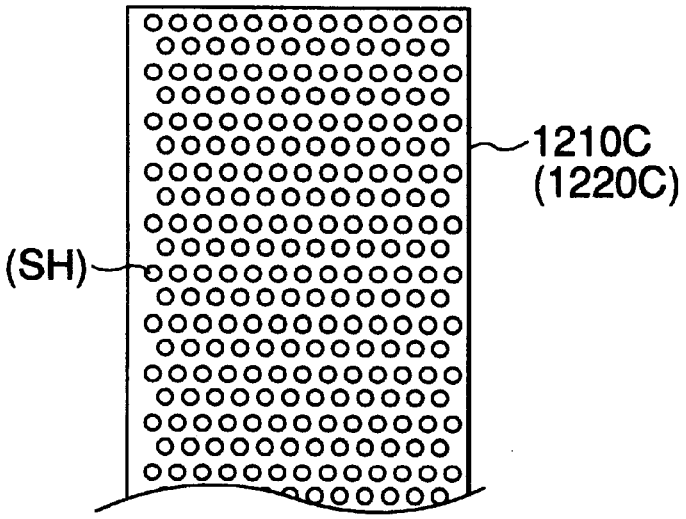
FIG. 19 is a magnified plan view of a portion of first and second detection plates of FIG. 18.
Figure 20:
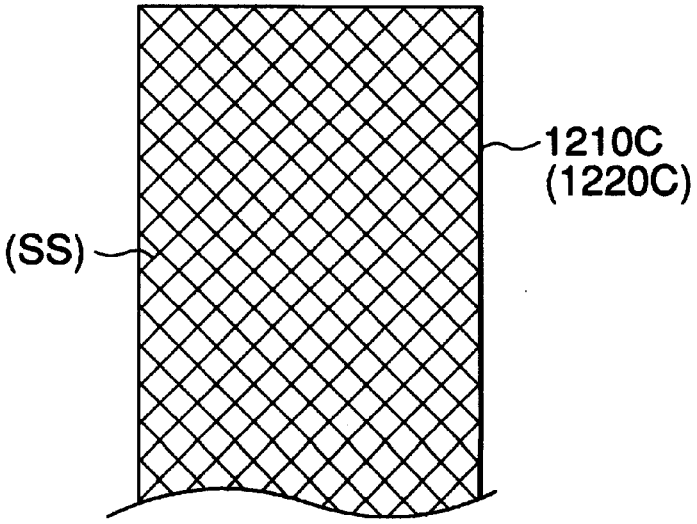
FIG. 20 is a magnified plan view of a portion of alternatively constructed first and second detection plates of FIG. 18.

Embodiment 9:

First and second detection plates 1210*c* and 1220*c* are shown in FIGS. 18 to 20 and are constructed in accordance with a ninth embodiment of the invention. First and second detection plates 1210*c* and 1220*c* are similar to first and second detection plates 210*a* and 220*a* of the seventh embodiment in general structure. However they are formed with small holes SH formed on the surface thereof, as shown in FIG. 19, or with small cross grooves SS formed on the surface thereof, as shown in FIG. 20.

Thus, the construction of first and second detection plates 1210*c* and 1220*c* with asperities (small holes SH or small cross grooves SS) formed on the surfaces thereof, locally increases the contract pressure with electrodes (not shown) on the raised portions of the plates for providing good electric conduction. Further, when the cartridge is mounted, both detection plates 1210*c* and 1220*c* rub against the electrodes and are vibrated. Thus, dust and the like which may be positioned between the electrodes and detection plates 1210*c* and 1220*c* is removed effectively. The electrical conduction between the electrodes and detection plates is insured, and a false detection ink depletion can be prevented.

Figure 21:
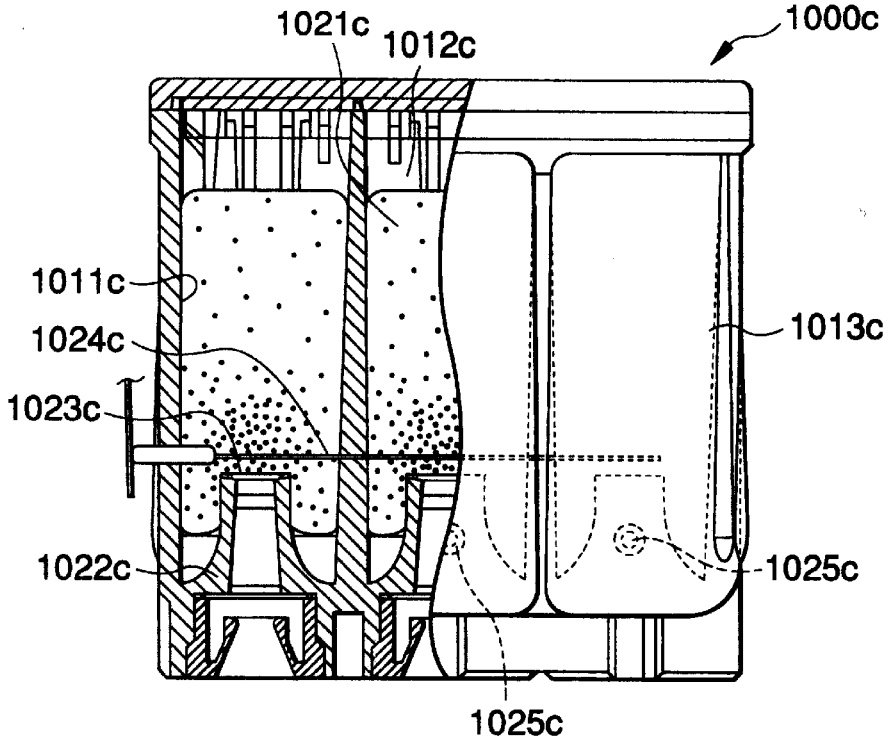
FIG. 21 is a cutaway cross-sectional view of an ink cartridge constructed in accordance with a tenth embodiment of the invention.

Embodiment 10:

An ink cartridge, depicted generally as 1000*c* and constructed in accordance with a tenth embodiment of the invention, is shown in FIG. 21. Ink cartridge 1000*c* differs from the ink cartridge 1000 of the sixth embodiment shown in FIG. 13 in that a first electrode 1024*c* is disposed so as to penetrate through different color ink chambers 1011*c*, 1012*c*, and 1013*c* contiguous with each other for detecting the depletion of ink from any of the ink chambers. A second electrode 1025*c* extends orthogonally of first electrode 1024*c* and is electrically coupled to the corresponding filter 1023*c*. According to this structure, the depletion of ink from any ink chambers 1011*c*, 1012*c*, and 1013*c* can be detected without error, and moreover the configuration of the detection circuit can be simplified.

Other components of the tenth embodiment are similar to those of the sixth embodiment of FIG. 11 and therefore are indicated by reference numerals with suffix c.

Figure 22:
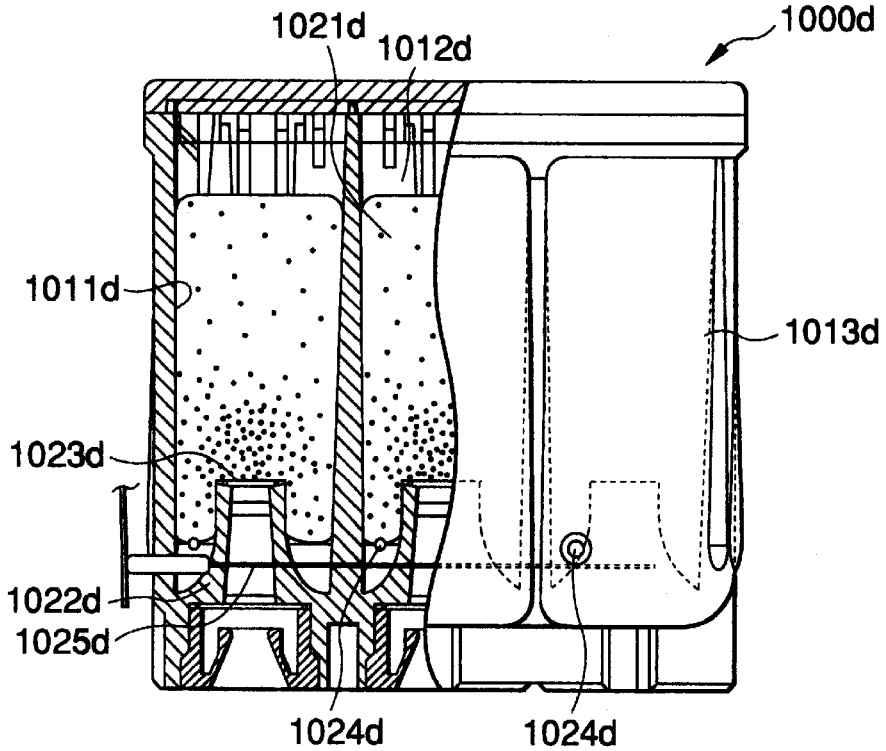
FIG. 22 is a cutaway cross-sectional view of an ink cartridge constructed in accordance with an eleventh embodiment of the invention.

Embodiment 11:

An ink cartridge, depicted generally as 1000*d* and constructed in accordance with an eleventh embodiment of the invention, is shown in FIG. 22. Ink cartridge 1000*d* differs from ink cartridge 1000*c* of the tenth embodiment shown in FIG. 21 in that a second electrode 1025*d* is disposed so as to penetrate through different color ink chambers 1011*d*, 1012*d*, and 1013*d* contiguous with each other for detecting the depletion of ink from any of the ink chambers. A first electrode 1024*d* extends orthogonally to second electrode 1025*d* in each chamber alongside each ink supply section. It has similar advantages to those of the ink cartridge 1*c* of the tenth embodiment.

Other components of the eleventh embodiment are indicated by reference numerals in the sixth embodiment of FIG. 11 to which suffix d is added.

Figure 23:
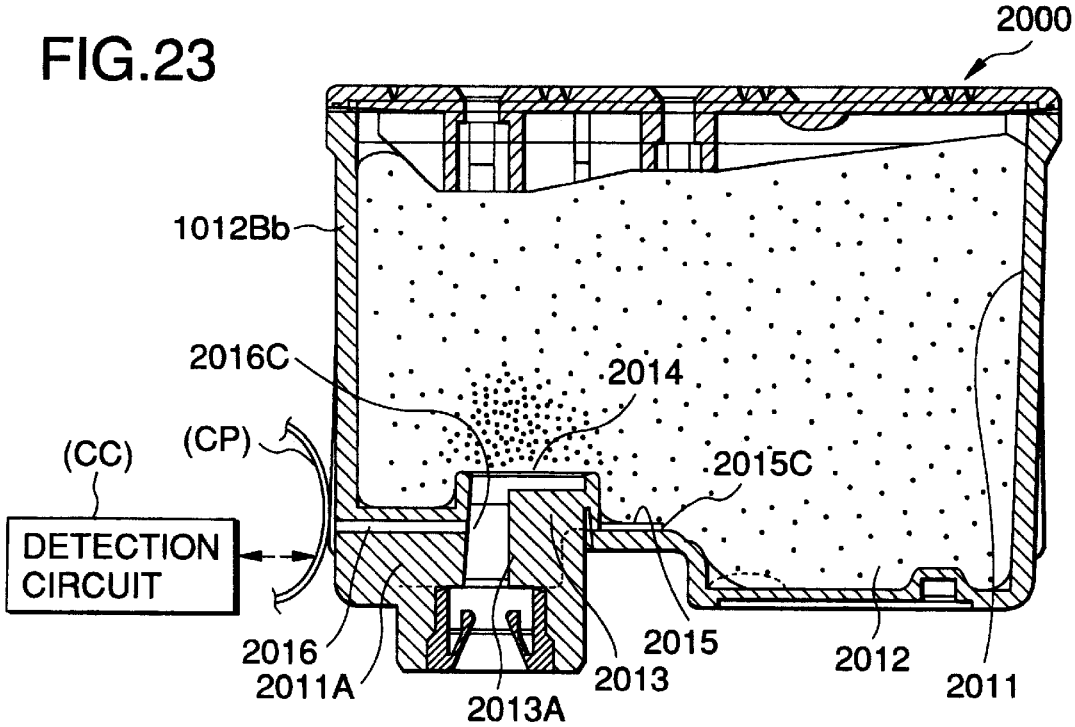
FIG. 23 is a cross-sectional view of an ink cartridge constructed in accordance with a twelfth embodiment of the invention.
Figure 24:
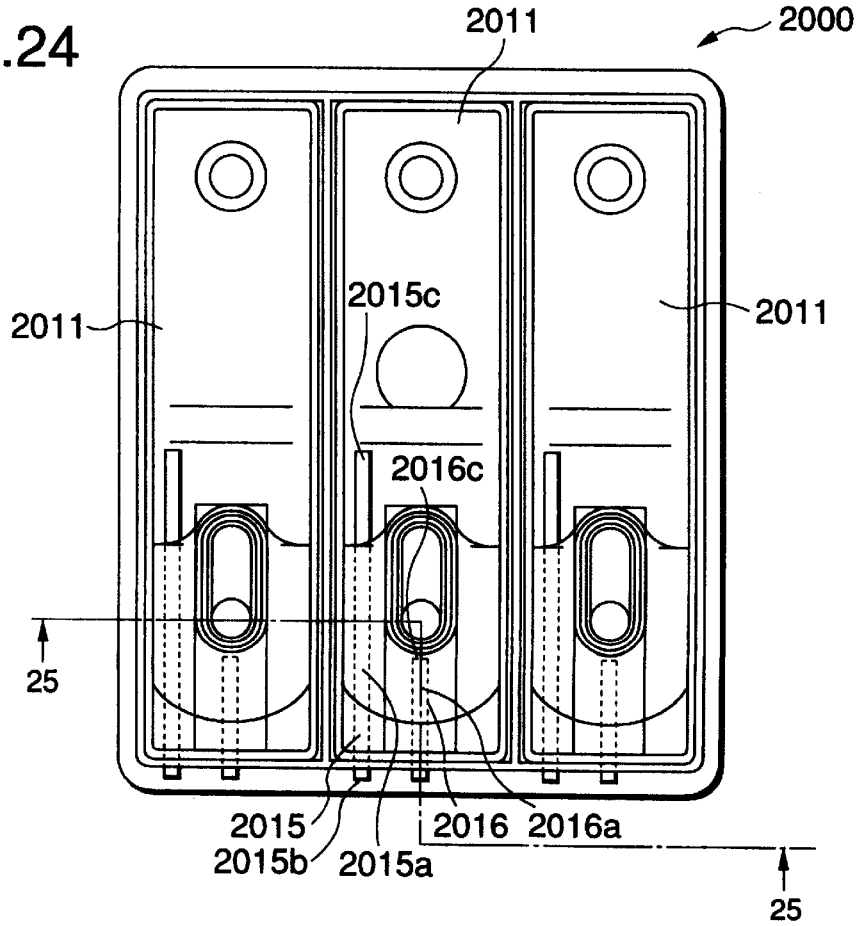
FIG. 24 is a bottom plan view of the ink cartridge of FIG. 23.
Figure 25:
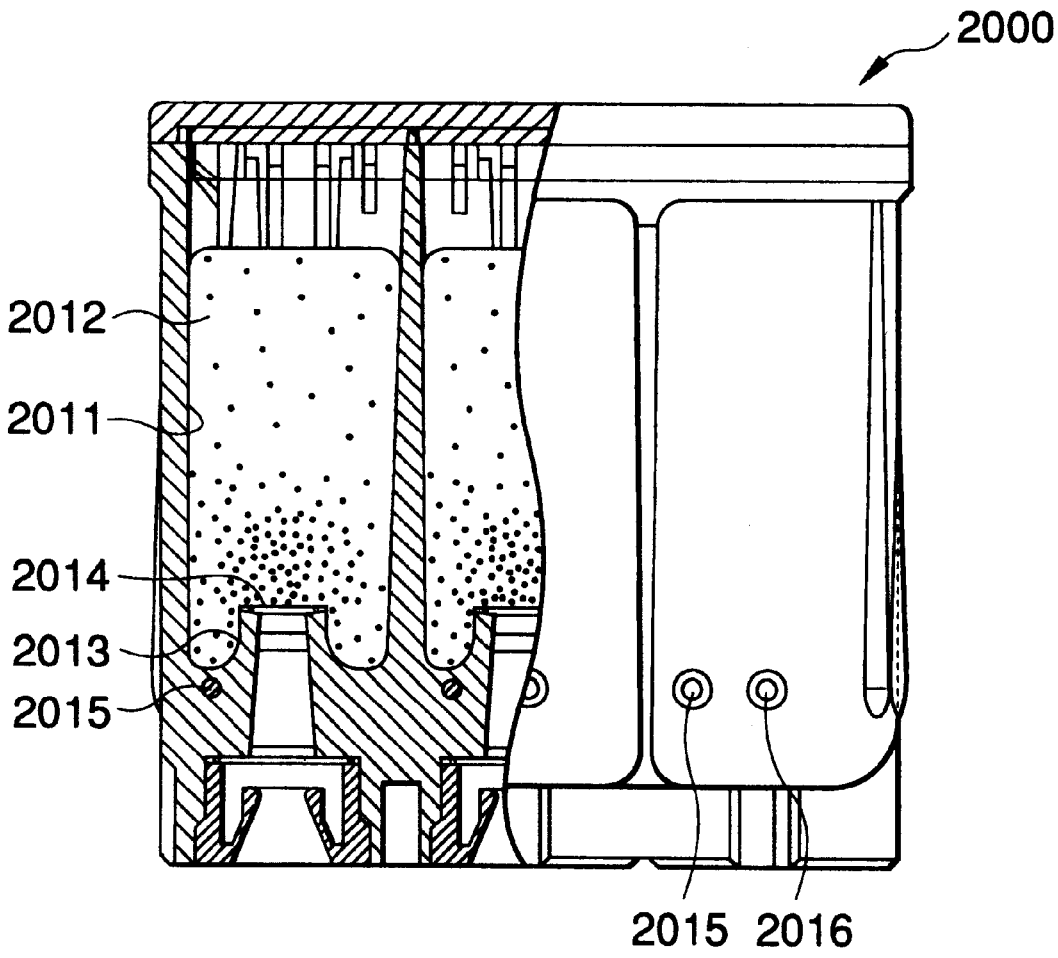
FIG. 25 is a cross-sectional view taken along line 25—25 of FIG. 24.

Embodiment 12:

An ink cartridge, depicted generally as 2000 and constructed in accordance with a twelfth embodiment of the invention, is shown in FIGS. 23–25. Ink cartridge 2000 comprises a plurality of ink chambers 2011, which, in a preferred embodiment are capable of separately storing different color inks of yellow, magenta, cyan, or the like. The construction of each of ink chambers 2011 are similar, and therefore are one ink vessel 2011 will be discussed as a representative of all ink chambers 2011.

Ink chamber 2011 contains porous member 2012 therein for retaining ink and a filter 2014 positioned on top of an ink supply section 2013, ink supply section 2013 projecting inward to the interior of ink cartridge 1000, as in conventional cartridges.

Ink vessel 2011 is provided with a pair of electrodes 2015, 2016 for detecting the amount of ink remaining in ink chamber 2011. First long electrode 2015 has an inner end portion 2015*c* which extends substantially to the center of ink chamber 2011 so that it is maintained in sufficient contact with porous member 2012. First electrode 2015 is formed with a base 2015*a* embedded in a raised bottom 2011A of ink chamber 2011 by insert molding, and an outer end portion 2015*b*, which is exposed to the outside of ink chamber 2011. A second short electrode 2016 is positioned adjacent first electrode 2015 has a base 2016*a* embedded in the raised bottom 2011A, which is formed by insert molding similar to first electrode 2015, and an inner end portion 2016*c* exposed to an ink supply port 2013A of an ink supply section 2013. Inner end portion 2016*c* is positioned to be able to come into contact with ink in ink supply port 2013A. If ink cartridge 2000 is loaded into a print head of a printer (not shown) so as to face the ink jet print head, first and second electrodes 2015 and 2016 are energized through detection plates (CP) by detection circuit (CC) of the printer and electricity is conducted therebetween by using ink retained within porous member 2012 in ink chamber 2011 as a conductive medium. The electric resistance value between first and second electrodes 2015 and 2016 varies with a change in the amount of ink remaining in ink chamber 2011. This variance in the electrical resistance is detected by detection circuit (CC).

As the ink in porous member 2012 is consumed, and the ink level decreases, the electric resistance value between first and second electrodes 2015 and 2016 increases. When the electric resistance value increases above a predetermined value, the depletion of ink from ink vessel can be detected. The ink flows through ink supply hole 2013A and comes into contact with inner portion 2016*c* of second electrode 2016 without being obstructed by second electrode 2016. Thus, bubbles are not generated in the ink and the ink is circulated with a regulated flow, so that the electrical resistance value between first and second electrodes 2015 and 2016 can be precisely measured for stable and accurate detection of the depletion of ink.

Therefore, cartridge 2000 will not be replaced with a new cartridge when ink still remains in cartridge 2000. Thus, the waste of ink is avoided and high-quality printing can be performed for a longer time.

Figure 26:
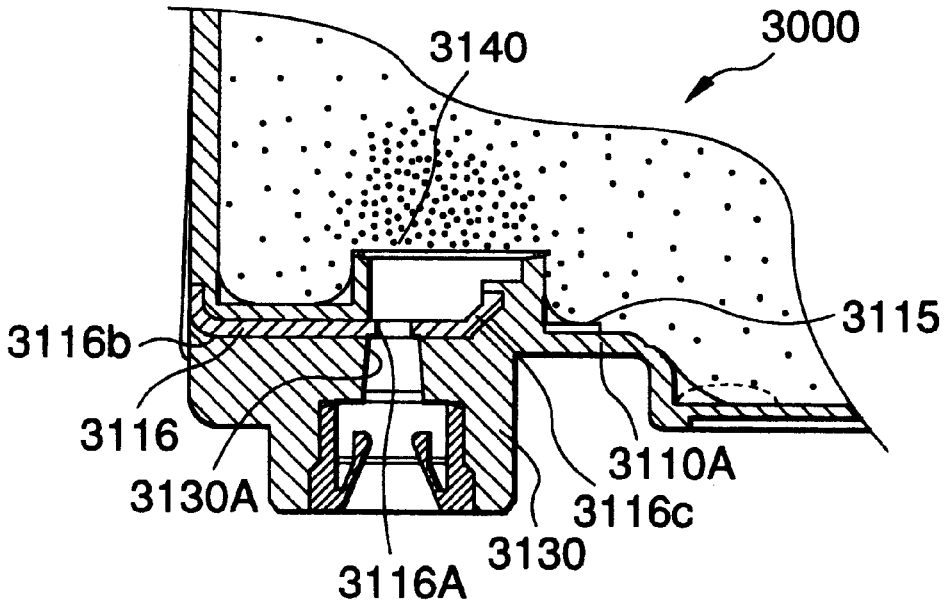
FIG. 26 is a fragmentary cross-sectional view of an ink cartridge constructed in accordance with a thirteenth embodiment of the invention.

Embodiment 13:

An ink cartridge, depicted generally as 3000 and constructed in accordance with a thirteenth embodiment of the invention, is shown in FIG. 26, only the ink supply portion thereof being shown. Ink cartridge 3000 differs from ink cartridge 2000 in that a second electrode 3116 has an intermediate area that extends across an ink supply port 3130A, and is therefore exposed in a traverse manner in ink supply port 3130A of an ink supply section 3130. An ink conducting through hole 3116A, smaller than ink supply port 3130A is formed in second electrode 3116. A base 3116B and an inner end portion 3116C are embedded in a raised bottom 3110A by insert molding. Other components and the procedure of abutting a detection plate (CP) against an L-shaped outer end of the second electrode are similar to those of the cartridge 1000 of the sixth embodiment. A first electrode 3115 extends into each chamber along bottom wall 3110A.

During use of cartridge 3000, ink is passed through a filter 3140, and is then passed through ink conducting hole 3116A of second electrode 3116, positioned within ink supply port 3130A for supplying the ink to a printer. Ink comes into contact with second electrode 3116 on the top face of second electrode 3116, along the inner face of ink conducting hole 3116A, and the bottom face of second electrode 3116. Thus, the amount of ink remaining in ink cartridge 3000 can be accurately detected.

Figure 27:
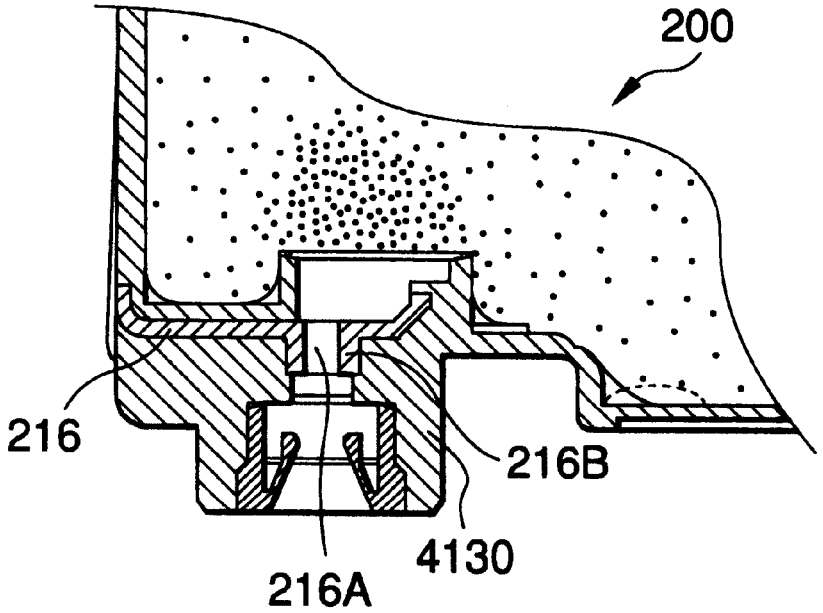
FIG. 27 is a fragmentary cross-sectional view of an ink cartridge constructed in accordance with a fourteenth embodiment of the invention.

Embodiment 14:

An ink cartridge, depicted generally as 200 and constructed in accordance with a fourteenth embodiment of the invention, is shown in FIG. 27, only the ink supply portion thereof being shown. Ink cartridge 200 differs from the cartridge 2000 or 3000 in that an ink conducting hole 216A is formed in a second electrode 216, and that ink conducting hole 216A is formed integrally with a cylindrical boss 216B extending toward the exterior end of ink supply section 4130. Other components are similar to those of ink cartridge 100 of the thirteenth embodiment.

That is, during use of cartridge 200, contact between the second electrode 216 and ink occurs over a wide range of the top face of the electrode 216, the wide inner cylindrical face of ink conducting hole 216A and the cylindrical boss 216B, and the bottom face of electrode 216 defined by the end of base 216B. Thus, the contact area between ink and second electrode 216 is furthermore increased and the depletion of ink from an ink cartridge 200 can be accurately detected. Cartridge 200 has effects similar to those of other embodiments.

The same description goes for other ink vessels provided with multi-color cartridge and therefore these additional ink vessels will not be discussed.

Figure 28:
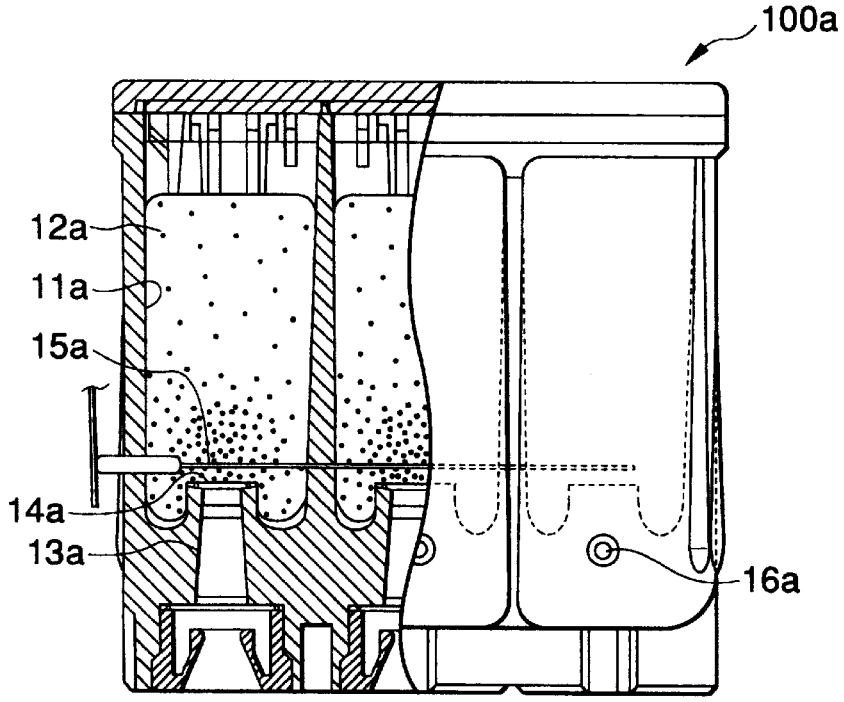
FIG. 28 is a cutaway cross-sectional side view of an ink cartridge constructed in accordance with a fifteenth embodiment of the invention.

Embodiment 15:

An ink cartridge, depicted generally as 100*a* and constructed in accordance with a fifteenth embodiment of the invention, is shown in FIG. 28. Ink cartridge 100*a* differs from ink cartridge 2000 of the twelfth embodiment shown in FIG. 23 in that a first electrode 15*a* is disposed so as to penetrate through different color ink chambers 11*a* contiguous with each other for detecting the depletion of ink from any of ink chambers 11*a*. One second electrode 16*a* associated with each ink chamber is positioned within each ink chamber in a direction orthogonal to said first electrode 15*a*, each passing through an associated ink supply section and ink supply port.

According to this structure, the depletion of ink in any of ink chambers 11*a* can be detected without error and the configuration of the detection circuit can be simplified.

Other components of the fifteenth embodiment are almost similar to those of the fourteenth embodiment and therefore are indicated by reference numerals with suffix a.

Figure 29:
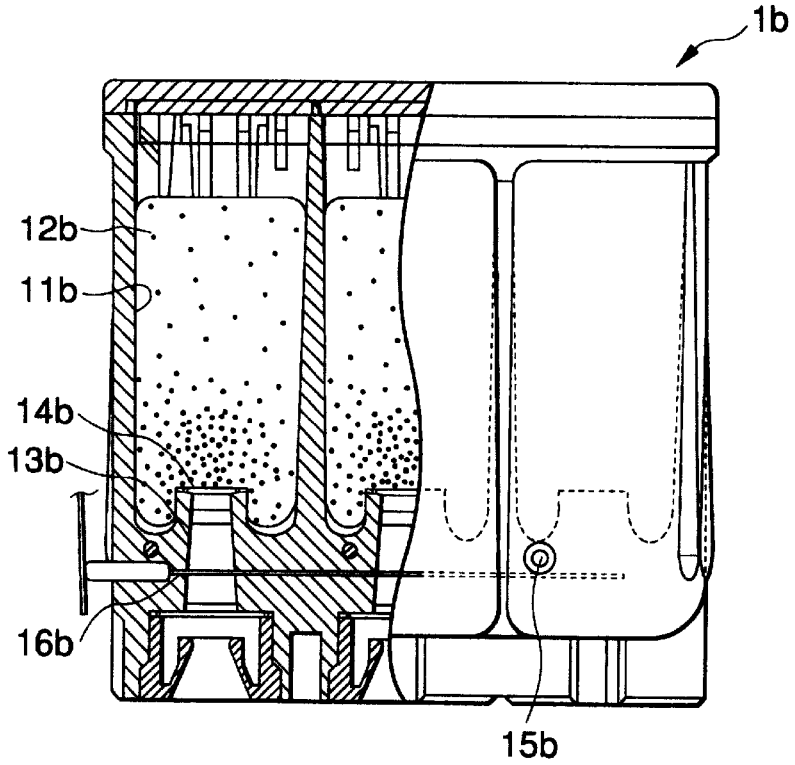
FIG. 29 is a cutaway cross-sectional side view of an ink cartridge constructed in accordance with a sixteenth embodiment of the invention.

Embodiment 16:

An ink cartridge, depicted generally as 100*b* and constructed in accordance with a sixteenth embodiment of the invention, is shown in FIG. 29. Ink cartridge 100*b* differs from the ink cartridge 100*a* of the fifteenth embodiment shown in FIG. 28 in that a second electrode 16*b* is disposed so as to penetrate through different color ink chambers 11*b* contiguous with each other for detecting the depletion of ink from any of ink chambers 11*b*. A first electrode 15*b* associated with each ink chamber is positioned within each ink chamber in a direction orthogonal to said second electrode, each first electrode being embedded in a portion of the wall of said ink cartridge 100*a*. It has similar advantages to those of the ink cartridge 100*a* of the fifteenth embodiment.

Other components of the sixteenth embodiment are indicated by reference numerals in FIG. 28 to which suffix b is added.

As a result of the invention, the depletion of ink from an ink cartridge can be detected with high accuracy and high-quality printing can be insured. Since the ink cartridge has a small number of components, it can be manufactured easily at low cost. Contact between the electrode pins and the electrode plates can be provided upon insertion of the ink cartridge in a printer. After a porous material is loaded into the ink cartridge, the electrode pins are made to penetrate the porous material, whereby assembly is facilitated. When the ink cartridge is replaced, printing can be continued by easy operation without disturbance. Since the filter may be used as one of the detection electrodes, the amount of ink remaining in the ink cartridge can be detected with high accuracy. Since the filter acts as an electrode, the spacing between the pair of electrodes is decreased, and the detection accuracy of the depletion of ink can be improved. Since the filter generates a larger capillary force than the compressed porous material in the ink tank adjacent the filter, all of the ink in the ink cartridge can be precisely detected and thus supplied for printing. Since the filter and porous material come into reliable contact with each other, the amount of ink remaining in the ink tank can be precisely detected. Since the filter or detection electrode may be formed having a coarse surface, good contact therebetween is provided and the remaining amount of ink can be precisely detected. Since the electrode may be embedded in the ink vessel by insert molding, a cartridge of a simple structure capable of sufficiently preventing ink leakage without the need for seals is provided.

In the invention, a cartridge is provided wherein ink can be supplied smoothly so as to prevent bubbles from occurring in the ink supply port, and good electrical contact between ink and an electrode is provided for preventing a false indication that the ink has been depleted from the ink tank.

In the invention a cartridge is provided wherein ink can be circulated smoothly in a boss constructed following an ink conducting hole formed in an electrode, and ink and the electrode are brought into contact with each other over an extremely wide area for aiding in further precisely detecting the depletion of ink. Since at least one electrode can be formed to pass through a plurality of ink chambers, the depletion of ink in any of the chambers can be detected, and the ink tank and detection production structure can be simplified and costs can be reduced.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween

What is claimed is:

1. An ink cartridge for an ink jet printer comprising:

an ink chamber;

an ink supply section formed in said ink chamber, said ink supply section defining an ink passageway in fluid communication with said ink chamber and coupled to said ink chamber at an ink supply port;

a filter disposed within said ink chamber over said ink supply port, separating said ink supply chamber from the ink passageway of said ink supply section a porous material contained within said ink chamber for retaining ink therein, a portion of said porous material being compressed above said filter; and a pair of electrode pins configured and positioned within said ink chamber for detecting the depletion of ink disposed proximal to said ink supply section, at least one of said pair of electrode pins being positioned in said compressed portion of said porous material.

2. The ink cartridge of claim 1, wherein said compressed portion of said porous material is compressed by said ink supply section, and each of said pair of electrode pins are positioned in said compressed portion of said porous material.

3. The ink cartridge of claim 1, wherein at least one of said electrode pins is formed as a thin needle.

4. The ink cartridge of claim 1, wherein said at least one of said pair of electrode pins passes completely through said compressed portion of said porous material.

5. The ink cartridge of claim 1, wherein one of said pair of electrode pins is disposed within said compressed portion of said porous material and the other of said pair of electrodes having a portion disposed within said ink passageway.

6. The ink cartridge of claim 1, wherein said pair of electrodes are adapted to abut against a detection plate, said detection plate being electrically coupled to a detection circuit of an ink end detection apparatus, said detection plate being formed with microscopic asperities in areas that contact said electrodes.

7. The ink cartridge of claim 6, wherein said microscopic asperities are formed as microscopic holes.

8. The ink cartridge of claim 6, wherein said microscopic asperities are formed as microscopic grooves.

9. The ink cartridge of claim 8, wherein said other of said pair of electrodes is constructed and arranged so as to permit substantially unimpeded flow of ink in said ink supply port.

10. The ink cartridge of claim 1, wherein one of said electrodes is electrically connected to said filter, and the other electrode is embedded in said ink chamber and is at least partially exposed within said ink supply port.

11. The ink cartridge of claim 10, wherein an ink conducting hole smaller than said ink supply port is defined by said other of said pair of electrodes, said ink conducting hole positioned coaxially with said ink supply port.

12. The ink cartridge of claim 10, further comprising a cylindrical boss extending within the periphery of, and coaxially with, said ink conducting hole.

13. An ink cartridge for a recorder, comprising:

an ink chamber;

an ink supply section defining an ink passageway, said ink supply section having a top portion formed in a bottom portion of said ink chamber;

a porous material contained within said ink chamber for retaining ink therein, a portion of said porous material being compressed in an area adjacent said ink supply section;

a filter disposed on said top portion of said ink supply section, said filter being formed of an electrically conductive material; and a pair of electrodes positioned within said ink chamber to detect the depletion of ink from said ink chamber, at least one of said electrodes being electrically connected to said filter.

14. The ink cartridge of claim 13 wherein said filter is constructed to generate a capillary force stronger than a capillary force generated by said porous member with respect to ink within said ink chamber.

15. The ink cartridge of claim 13, comprising an electrical conductor having two ends, said electrical conductor coupled at one end to said filter and coupled at the other end to said at least one of said pair of electrodes.

16. The ink cartridge of claim 13, wherein said ink chamber includes a raised bottom portion positioned adjacent said ink supply section and lower than said filter and the other of said electrodes is disposed on said bottom portion.

17. The ink cartridge of claim 13, wherein said ink chamber includes a side wall through which said at least one electrode extends, and wherein said at least one of said electrodes includes an outer portion having a free end disposed outside said ink chamber, said free end formed to to contact said side wall, and an intermediate projection projecting away from said side wall of said cartridge, said intermediate projection adapted to be brought into resilient contact with a detection plate of conductive material.

18. The ink cartridge of claim 13, wherein one of said electrodes comprises a first portion embedded in a portion of the ink chamber and a second, portion positioned outside of the ink chamber, said first portion including said filter.

19. The ink cartridge of claim 13, wherein said ink supply section is formed with an enlarged projection, projecting into the interior of the ink chamber and wherein a portion of said filter is embedded within said enlarged projection.

20. The ink cartridge of claim 13, wherein:

said pair of electrodes are adapted to abut against a detection plate, said detection plate being electrically coupled to a detection circuit of an ink end detection apparatus, said detection plate being formed with microscopic asperities in areas that contact said electrodes.

21. The ink cartridge of claim 20 wherein the microscopic asperities are formed as microscopic holes.

22. The ink cartridge of claim 20 wherein the microscopic asperities are formed as microscopic grooves.

23. The ink cartridge of claim 22, wherein an ink conducting hole smaller than said ink supply port is defined by said one electrode positioned coaxially with said ink supply port.

24. The ink cartridge of claim 23, further comprising a cylindrical boss extending within the periphery of, and coaxially with said ink conducting hole of said one electrode.

25. The ink cartridge of claim 24, wherein said one electrode is constructed and positioned so as to permit substantially unimpeded flow of ink in said ink supply port.

26. The ink cartridge of claim 13, wherein said ink supply section is formed within said ink chamber, said ink supply section defining an ink supply port;

a porous material contained within said ink chamber for retaining ink therein; and wherein one of said electrodes is electrically connected to said filter, and the other electrode is embedded in said ink chamber and partially exposed within said ink supply passageway.

27. The ink cartridge of claim 13, wherein said ink chamber includes a side wall through which said at least one electrode extends, and wherein said at least one of said pair of electrodes includes an outer portion having a free end disposed outside said ink chamber, said outer portion being bent to define a first region extending generally along and toward said side wall at a first location and bent at a second location to define a second region extending generally along and away from said side wall, thereby forming an elastic biasing member adapted to be brought into elastic contact with a detection plate.

28. An ink cartridge, comprising:

a plurality of ink chambers, each capable of separately storing different color inks;

a porous member positioned within each of said plurality of ink chambers; and at least one electrode being positioned within more than one of said plurality of chambers at one, said at least one electrode aiding in the detection of the depletion of ink from any of said more than one chambers.

29. An ink cartridge, comprising:

a plurality of ink chambers, each defining an inner volume capable of separately storing different colors of ink;

a first electrode exposed to said inner volume of each of said plurality of ink chambers; and a plurality of second electrodes, each one of said plurality of second electrodes having a portion exposed to said inner volume of a separate ink chamber of said plurality of ink chambers.

30. An ink cartridge for an ink jet printer, comprising:

an ink chamber having a first side wall, a second side wall and a bottom wall;

an ink supply section formed on the bottom wall, said ink supply section being located closer to said first side wall than said second side wall;

a porous material contained within said ink chamber for retaining ink therein, a compressed portion of said porous material being in a compressed condition above said ink supply section; and a pair of electrodes for detecting the depletion of ink disposed in the proximity of said ink supply section, at least one of said electrodes extending from said first side wall into said compressed portion of said porous material.

31. The ink cartridge of claim 30, wherein said porous material is compressed by said ink supply section, and each of said pair of electrodes are positioned in the compressed portion of said porous material.

32. The ink cartridge of claim 30, wherein at least one of said pair of electrodes is formed as a thin needle.

33. The ink cartridge of claim 32, wherein said at least one of said pair of electrode pins passes completely through said compressed portion of said porous member.

34. The ink cartridge of claim 30, wherein said at least one of said pair of electrodes is disposed within said compressed portion of said porous material and the other of said pair of electrodes is disposed in said ink supply section.

35. The ink cartridge of claim 30, wherein said pair of electrodes are adapted to abut against a detection plate, said detection plate being electrically coupled to a detection circuit of an ink end detection apparatus, said detection plate being formed with microscopic asperities in areas that contact said electrodes.

36. The ink cartridge of claim 35, wherein the microscopic asperities are formed as microscopic holes.

37. The ink cartridge of claim 35, wherein the microscopic asperities are formed as microscopic grooves.

38. The ink cartridge of claim 37, wherein said other of said pair of electrodes is constructed so as to permit substantially unimpeded flow of ink in said ink supply section.

39. The ink cartridge of claim 35, wherein one of said pair of electrodes comprises a first portion embedded in a portion of the ink cartridge and a second, portion positioned outside of the ink chamber, said first portion including said filter.

40. The ink cartridge of claim 39, further comprising a cylindrical boss extending within the periphery of, and coaxially with, said ink conducting hole.

41. The ink cartridge of claim 35, including an ink supply port at an inner end of said ink supply section, wherein an ink conducting hole smaller than said ink supply port is defined by said other of said electrodes, said ink conducting hole positioned coaxially with said ink supply port.

42. An ink cartridge system, comprising:

an electrically conductive contact plate;

an ink chamber having a bottom wall;

an ink supply section formed on the bottom wall;

a porous material contained within said ink chamber for retaining ink therein; and a pair of electrodes adapted to abut against said contact plate, said contact plate being electrically coupled to a detection circuit of an ink end detection apparatus, said contact plate being formed with microscopic asperities in areas that contact said electrodes.

43. The ink cartridge system of claim 42, wherein the microscopic asperities are formed as microscopic holes.

44. The ink cartridge system of claim 42, wherein the microscopic asperities are formed as microscopic grooves.

45. The ink cartridge system of claim 42, wherein a compressed portion of said porous material is compressed above said ink supply section.

46. The ink cartridge system of claim 45, wherein one of said electrodes extends into the compressed portion.

* * * * *